US010472755B2

(12) United States Patent
Kongo

(10) Patent No.: US 10,472,755 B2
(45) Date of Patent: Nov. 12, 2019

(54) SEWING MACHINE

(71) Applicant: Janome Sewing Machine Co., Ltd., Hachioji-shi, Tokyo (JP)

(72) Inventor: Takeshi Kongo, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 103 days.

(21) Appl. No.: 15/889,462

(22) Filed: Feb. 6, 2018

(65) Prior Publication Data

US 2018/0230633 A1 Aug. 16, 2018

(30) Foreign Application Priority Data

Feb. 15, 2017 (JP) ..... 2017-025617

(51) Int. Cl.

| | |
|---|---|
| ***D05C 5/04*** | (2006.01) |
| ***D05B 21/00*** | (2006.01) |
| ***D05B 39/00*** | (2006.01) |
| ***D05B 69/12*** | (2006.01) |
| ***D05C 9/04*** | (2006.01) |

(52) U.S. Cl.

CPC ..... *D05C 5/04* (2013.01); *D05B 21/00* (2013.01); *D05B 39/00* (2013.01); *D05B 69/12* (2013.01); *D05C 9/04* (2013.01); *D05D 2205/02* (2013.01)

(58) Field of Classification Search

CPC ..... D05C 5/00–06; D05C 9/00–06; D05B 21/00; D05B 39/00; D05B 69/00; D05B 69/12; D05B 69/20–28; D05B 69/36; D05D 2205/02; D05D 2205/32; G06F 1/04; G06F 3/00

See application file for complete search history.

(56) References Cited

U.S. PATENT DOCUMENTS 4,365,565 A * 12/1982 Kawai ..... D05B 21/00 112/103
4,622,907 A * 11/1986 Kimura ..... D05B 19/08 112/102.5
5,001,996 A * 3/1991 Tajima ..... D05C 5/04 112/103

(Continued)

FOREIGN PATENT DOCUMENTS

JP 2649798 B2 5/1997
JP 2000296282 A 10/2000
JP 2001113068 A 4/2001

*Primary Examiner* — Ismael Izaguirre
(74) *Attorney, Agent, or Firm* — Nath, Goldberg & Meyer; Jerald L. Meyer

(57) ABSTRACT

A sewing machine includes an embroidery data memory unit, a suspension timing selecting unit, and a suspension control unit. The embroidery data memory unit stores embroidery data, and accepts a planned suspension timing, a sewing suspending instruction, and a sewing resuming instruction. The suspension timing selecting unit selects a discontinuous operation that breaks the continuity of seams within the predetermined range before and after the planned suspension timing from the embroidery data. The suspension control unit maintains the deactivation of a sewing-machine motor until the suspending instruction or the resuming instruction is input when the selected discontinuous operation by the suspension timing selecting unit comes during the sewing of embroidery pattern.

11 Claims, 27 Drawing Sheets

(56) References Cited

U.S. PATENT DOCUMENTS

| | | | | |
|---|---|---|---|---|
| 5,613,163 | A * | 3/1997 | Marron | G06F 13/126 710/1 |
| 6,370,443 | B2 * | 4/2002 | Kim | D05B 19/08 112/102.5 |
| 2006/0064195 | A1 * | 3/2006 | Kern | D05B 19/12 700/138 |
| 2008/0223275 | A1 * | 9/2008 | Kishi | D05B 19/10 112/102.5 |
| 2015/0378651 | A1 * | 12/2015 | Asai | G06F 3/1204 358/1.15 |

* cited by examiner

61

64

| MOVING AMOUNT INFORMATION (mm) | ROTATION SPEED INFORMATION (rpm) | REQUIRED TIME INFORMATION (sec) |
|---|---|---|
| 0. 0~0. 9 | 650 | 0. 09 |
| 1. 0~1. 9 | 600 | 0. 10 |
| 2. 0~2. 9 | 550 | 0. 11 |
| 3. 0~3. 9 | 500 | 0. 12 |
| 4. 0~4. 9 | 450 | 0. 13 |
| 5. 0~5. 9 | 400 | 0. 15 |
| 6. 0~6. 9 | 350 | 0. 17 |
| 7. 0~7. 9 | 300 | 0. 20 |
| 8. 0~8. 9 | 250 | 0. 24 |
| 9. 0~9. 9 | 200 | 0. 30 |
| 10. 0~10. 9 | 150 | 0. 40 |
| 11. 0~11. 9 | 100 | 0. 60 |
| 12. 0~12. 7 | 80 | 0. 75 |
| Jump | 80 | 0. 80 |
| ColorChange | 80 | 120. 00 |

62 63 65 63 66 63 64 64

*FIG. 8*

SEWING MACHINE

CROSS-REFERENCE TO RELATED APPLICATION

This application is based upon and claims the benefit of priority from Japan Patent Application No. 2017-025617, filed on Feb. 15, 2017, the entire contents of which are incorporated herein by reference.

FIELD OF THE INVENTION

The present disclosure relates to a sewing machine for embroidery.

BACKGROUND

Sewing machines relatively moves a needle dropping position in accordance with embroidery data, and sews an embroidery pattern indicated by the embroidery data on a sewing object, such as a cloth and a leather. Such sewing machines stretches and holds the sewing object by an embroidery frame, and horizontally moves the embroidery frame along the plane of a bed unit, and changes the needle dropping position. The operation procedure to form an embroidery pattern is described in the embroidery data. For example, moving amount information of the embroidery frame for reaching the next seam is listed in the embroidery data. This moving amount information can also be considered as the relative coordinates of a seam.

As for embroidery patterns, a large and complicated pattern may be formed by, for example, 200000 stitches or more. It takes over 7 hours or more to complete the sewing even if a sewing-machine motor is continuously rotated at, for example, 500 rpm.

An embroidery pattern may be formed by a plurality of embroidery blocks. Sewing machines which sew the embroidery pattern formed by the plurality of embroidery blocks once intermits the sewing machine motor when sewing of one embroidery block is completed, and only moves the embroidery frame to transit to the sewing of the next embroidery block. This sequential operation is called a jump operation. Since the sewing-machine motor is deactivated, the jump operation requires a time longer than a seam formation operation of inserting a needle to the sewing object.

In addition, an embroidery pattern may be formed by a plurality of colored threads. Sewing machines which sew the embroidery pattern formed by the plurality of colored threads, intermits the sewing machine motor in order to change the thread to a thread with the next color, and stand by until a user depresses a start button after the user changes the colored thread. This sequential operation is called a color changing operation. Since the color changing operation involves the user's work, the color changing operation requires a time longer than the seam formation operation. When the user is absent at the timing of the color changing operation or the user is unexperienced in the color changing operation, the required time becomes further long.

Accordingly, as for the embroidery pattern formed by 200000 stitches or more, at least 10 hours or longer are required in many cases. However, the user cannot concentrate on only the sewing. Hence, conventionally, a technology of calculating a completion time of an embroidery pattern by a sewing machine, and presenting the calculated time to the user has been proposed (see, for example, JP 2001-113068 A and Japan Patent No. 2649798). When the completion time of the embroidery pattern is known, the user can easily plan a schedule regarding the sewing machine embroidery.

In addition, when sewing of an embroidery pattern requires a large amount of time, the user may want to simultaneously carry out other works, such as shopping and cleaning, along with the sewing work. Hence, a technology of calculating the required time for each colored thread by the sewing machine, and presenting the calculated time to the user has also been proposed (see, for example, JP 2000-296282 A). Presenting the calculated time allows the user to know a time interval between the next color change and the further next color change, facilitating the user to simultaneously carry out the other works, such as shopping and cleaning.

When the timing which the user should carry out an activity, such as an appointment for a lunch with a friend, other than the sewing has been set, it is difficult for the user to simultaneously carry out other works with the sewing of the embroidery pattern that requires at least 10 hours or more even if the completion time for the embroidery pattern is known.

In addition, even if each required time for each colored thread is individually presented, the activity that can be taken within the necessary time is limited, making it difficult for the user to plan a schedule considering both an activity with a set timing, such as an appointment for a lunch with a friend, and the sewing machine embroidery.

Hence, when the user attempts to set a schedule considering both the sewing and other activities that require time, the user needs to keep watching a clock or to set an alarm in a way that the time will not elapse due to the user's concentration on the sewing work. That is, the user has no choice but to continue the sewing work under the schedule management toward the timing set by the user.

Moreover, even the timing set by the user comes, the user cannot forcibly suspend the embroidery in the halfway of the procedure, cut the thread to put up the sewing machine and the embroidery creation. If the embroidery is forcibly terminated in the halfway of the procedure, even when the embroidery is resumed from the subsequent seam, the seams are not connected smoothly, and the quality of the embroidery creation decreases. In the case of a large and complicated embroidery pattern, however, it is quite difficult for the user to pay attention to the advancement of the embroidery pattern and the prediction of the sewing-machine operation up to the finish of the embroidery pattern, and to determine an appropriate suspension timing of the sewing, decreasing the motivation for sewing the embroidery pattern.

The present disclosure has been proposed in order to address the foregoing technical problems of conventional technologies, and an objective is to provide a sewing machine capable of suspending sewing of an embroidery pattern at a free and appropriate timing set by a user without causing the user to pay attention.

SUMMARY OF THE INVENTION

In order to accomplish the above objective, a sewing machine according to the present disclosure sews an embroidery pattern in a sewing object, and the sewing machine includes:

a frame driving unit moving an embroidery frame on which the sewing object is placed and stretched;

a needle bar supporting a needle that inserts a thread in the sewing object, and reciprocating in an axial direction;

a sewing-machine motor that is a driving source of the needle bar; and a control unit controlling the frame driving unit and the sewing-machine motor, in which the control unit includes:

an input unit accepting, regardless of an advancement of sewing, input of a fixed planned suspension timing, a suspending instruction of sewing, and a sewing resuming instruction;

an embroidery data memory unit storing embroidery data which describes an operation procedure for forming an embroidery pattern;

a suspension timing selecting unit selecting an operation which breaks a continuity of seams within a predetermined range before and after the planned suspension timing accepted by the input unit; and a suspension control unit maintaining, when operation which breaks a continuity of seams selected by the suspension timing selecting unit comes, a deactivation of the sewing-machine motor until at least the suspending instruction or the resuming instruction is input, during the sewing of the embroidery pattern.

The control unit may further include an informing unit informing a user an incoming of the operation which breaks a continuity of seams selected by the suspension timing selecting unit during the sewing of the embroidery pattern.

The suspension timing selecting unit may select the operation which breaks the continuity of seams nearest to the planned suspension timing.

The control unit may further include a screen display device, and the suspension timing selecting unit may display, on the screen display device, the operation which breaks the continuity of seams within a predetermined range before and after the planned suspension timing, and selects one of the operations which break the continuity of seams selected by a user from the screen display device via the input unit.

The suspension timing selecting unit may display, on the screen display device, the operations which break the continuity of seams arranged type by type.

The operation which breaks the continuity of seams may be a jump operation of changing a pattern block to be sewn among the plurality of the pattern blocks of the embroidery pattern, or a color changing operation of changing the threads to the threads with different colors.

The input unit may accept a sewing resuming operation by the user to the deactivated sewing-machine motor that is not automatically driven again, the suspension timing selecting unit may re-select one of the operations which break the continuity of seams within a predetermined range before and after the planned suspension timing among the embroidery data of after the resuming every time the sewing resuming operation is input, and the suspension control unit may maintain, when operation which breaks a continuity of seams re-selected by the suspension timing selecting unit comes, a deactivation of the sewing-machine motor until the suspending instruction or the resuming instruction is input, during the sewing of the embroidery pattern.

The control unit may further include a table memory unit storing a table which describes a time required for moving the embroidery frame, and a time required for the operation which breaks the continuity of seams, the suspension timing selecting unit may calculate a difference between the planned suspension timing and an execution timing of the operation which breaks the continuity of seams based on the table and the embroidery data, and detect the operation which breaks the continuity of seams within a predetermined range before and after the planned suspension timing based on the difference.

The control unit may further include a table creating unit updating the time required for the operation which breaks the continuity of seams within the table based on a time actually required from a start of execution of the operation which breaks the continuity of seams until the next operation in the past.

The control unit may further include a non-volatile memory, and the suspension control unit may store, when the suspending instruction is input, the embroidery data and information indicating the operation next to the operation which breaks the continuity of seams involving the deactivation of the sewing-machine motor selected by the suspension timing selecting unit in the non-volatile memory.

The informing unit may inform the user the coming of the operation which breaks the continuity of seams every time a new operation which breaks the continuity of seams comes as long as the resuming instruction is input.

According to the present disclosure, the embroidery pattern sewing can be stopped at an appropriate timing near the timing that is set freely by the user. Hence, it is unnecessary for the user to pay attention to the advancement of the embroidery pattern and the operation prediction of the sewing machine up to the completion of embroidery pattern, and an embroidery creation with an excellent quality can be completed.

BRIEF DESCRIPTION OF THE DRAWINGS

FIG. 8 is a schematic diagram of a required time table;

DETAILED DESCRIPTION OF THE EMBODIMENTS

A sewing machine according to respective embodiments of the present disclosure will be described in detail with reference to the figures.

First Embodiment (Entire Structure)

Figure 1:
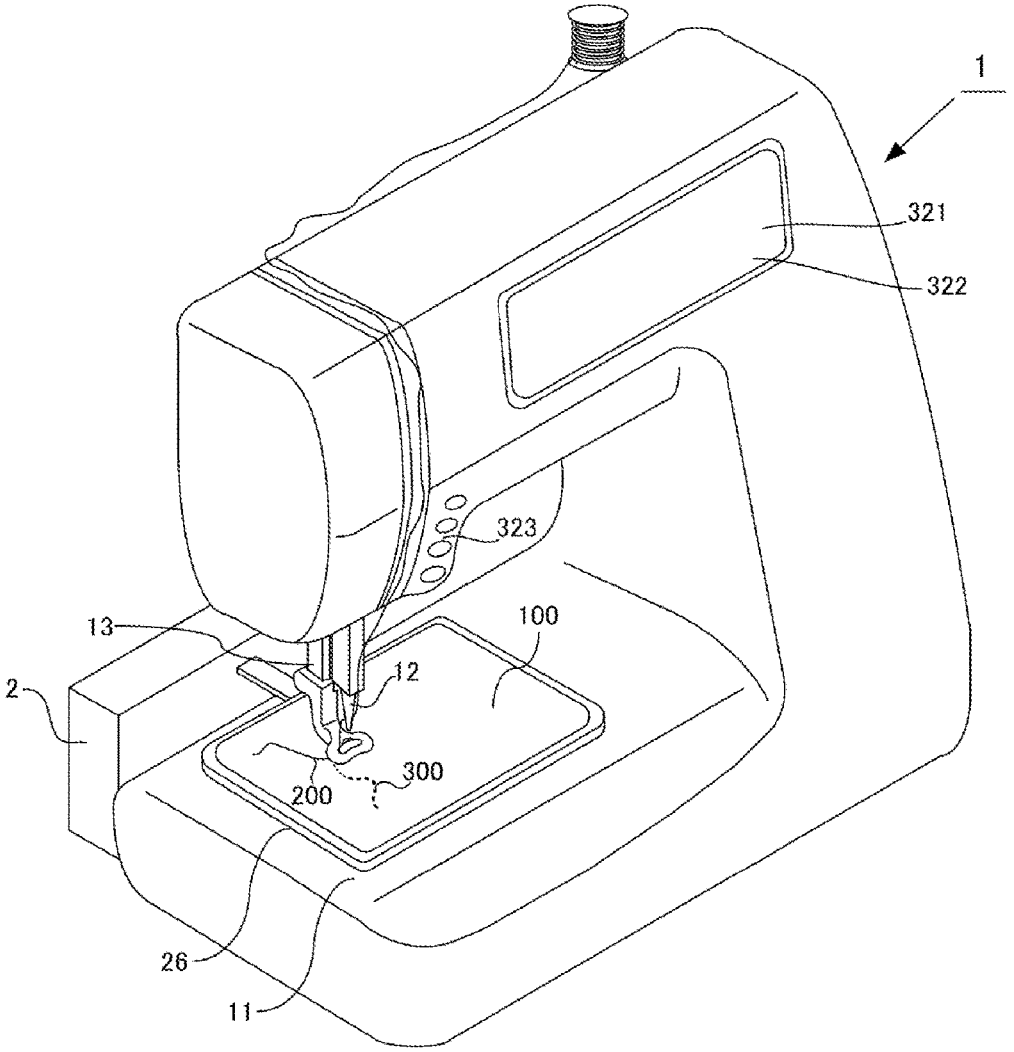
FIG. 1 is a diagram illustrating an entire structure of the external appearance of a sewing machine.

A sewing machine 1 illustrated in FIG. 1 is a household-use, professional, or industrial device that performs embroidery on a sewing object, such as a cloth or a leather. This sewing machine 1 inserts and removes a needle 12 relative to a sewing object 100 stretched on the plane of a bed unit 11, intertwines a needle thread 200 and a bobbin thread 300 with each other, and forms seams in the sewing object 100.

This sewing machine 1 includes a frame driving device 2. The frame driving device 2 horizontally moves an embroidery frame 26, on which the sewing objects 100 is stretched, above the bed unit 11. The sewing machine 1 that includes the frame driving device 2 horizontally moves the embroidery frame 26, and changes the seam formation position on the sewing object 100 so as to form an embroidery pattern that is a collection of seams.

Figure 4:
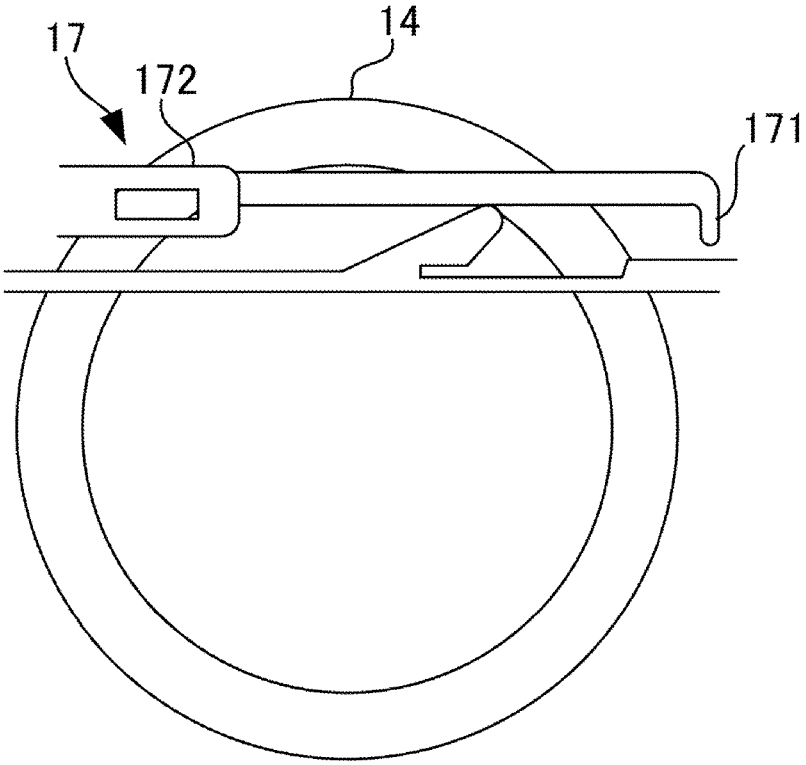
FIG. 4 is a diagram illustrating a detailed structure of a thread cutting mechanism.

The embroidery pattern can be formed by a plurality of colors. As illustrated in FIG. 4, the sewing machine 1 includes a thread cutting mechanism 17. The thread cutting mechanism 17 cuts the needle thread 200 and the bobbin thread 300 to change the colored thread. When the needle thread 200 and the bobbin thread 300 are cut, a user sets the threads with the next color to the sewing machine 1, and resumes the operation of the sewing machine 1.

(Sewing Machine Body)

Figure 2:
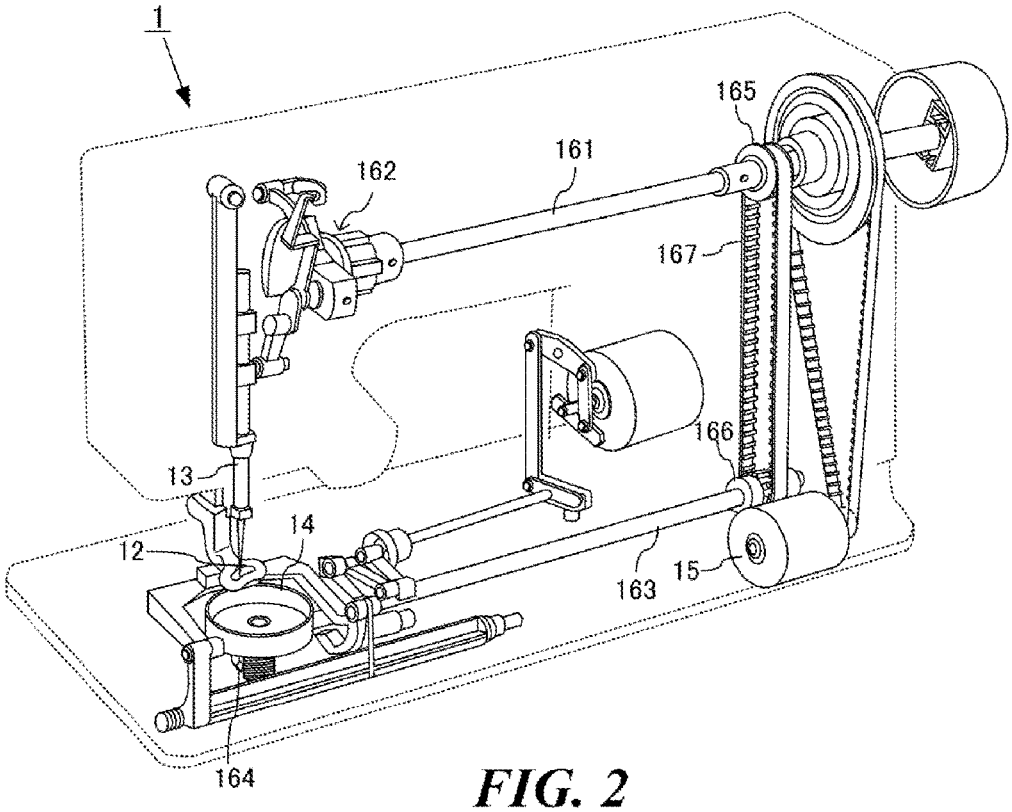
FIG. 2 is a diagram illustrating an internal structure of the sewing machine.

As illustrated in FIG. 2, the sewing machine 1 includes a needle bar 13 and a shuttle 14. The needle bar 13 extends vertically relative to the plane of the bed unit 11, and reciprocates in the axial direction. This needle bar 13 supports the needle 12 that holds the needle thread 200 at the tip located at the bed-unit-11 side. The shuttle 14 has a drum shape with a hollow interior and with one plane opened, is attached horizontally or vertically, and can be turned in the circumferential direction. In this embodiment, the shuttle 14 is attached horizontally. This shuttle 14 holds therein a bobbin which the bobbin thread 300 is wound around.

In this sewing machine 1, the needle 12 with the needle thread 200 penetrates the sewing object 100 by the vertical movement of the needle bar 13, and a needle-thread loop is formed due to a friction between the sewing object 100 and the needle thread 200 when the needle 12 moves up. Next, the needle-thread loop is caught by the turning shuttle 14, and the bobbin that has supplied the bobbin thread 300 passes through the needle-thread loop along with the turning of the shuttle 14. Hence, the needle thread 200 and the bobbin thread 300 are intertwined with each other, and a seam is formed.

The needle bar 13 and the shuttle 14 are driven via various transmission mechanisms with a sewing-machine motor 15 being a common drive source. An upper shaft 161 extending horizontally is connected to the needle bar 13 via a crank mechanism 162. The crank mechanism 162 converts the rotation of the upper shaft 161 into linear motion, and transmits to the needle bar 13 to move the needle bar 13 up and down. A lower shaft 163 extending horizontally is connected to the shuttle 14 via a gear mechanism 164. When the shuttle 14 is installed horizontally, the gear mechanism 164 is a cylindrical worm gear that has an axial angle of, for example, 90 degrees. The gear mechanism 164 converts the rotation of the lower shaft 163 by 90 degrees and transmits to the shuttle 14 to turn the shuttle 14 turns horizontally.

The upper shaft 161 is provided with a pulley 165 having a predetermined number of teeth. In addition, the lower shaft 163 is provided with a pulley 166 having the same number of teeth as that of the pulley 165 of the upper shaft 161. Both the pulleys 165 and 166 are linked with each other via a toothed belt 167. When the upper shaft 161 rotates along with the rotation of the sewing-machine motor 15, the lower shaft 163 also rotates via the pulley 165 and the toothed belt 167. This enables the needle bar 13 and the shuttle 14 to operate synchronously.

(Frame Driving Device)

Figure 3:
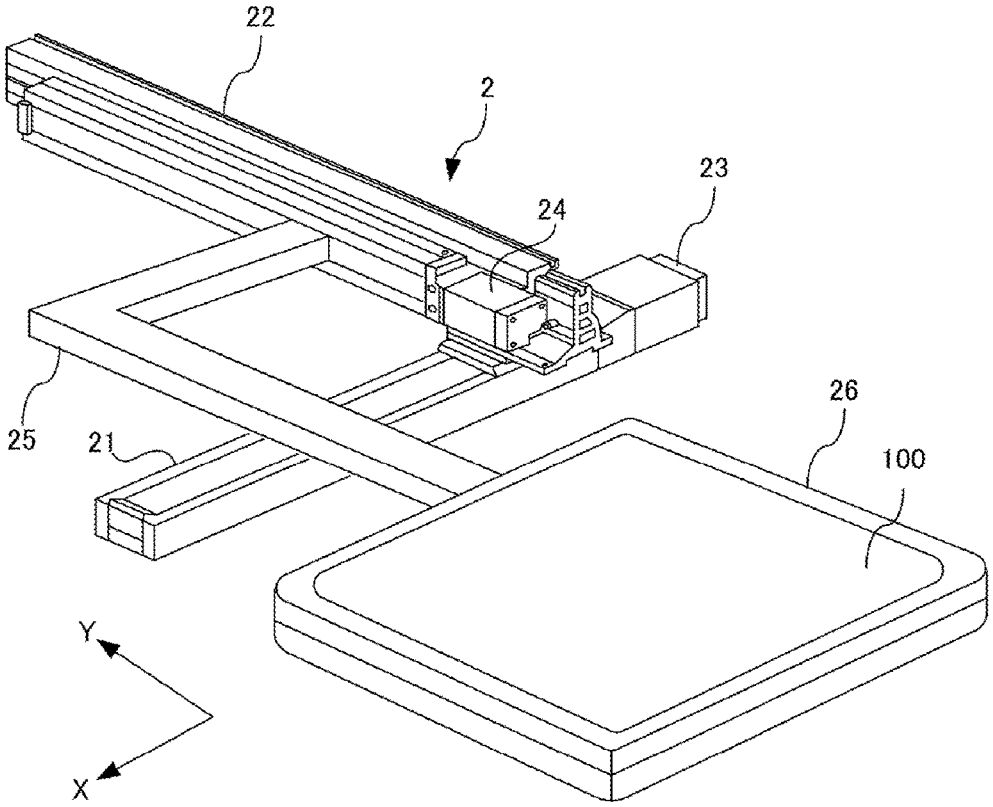
FIG. 3 is a diagram illustrating a detailed structure of a frame driving device.

As illustrated in FIG. 3, the frame driving device 2 is attachably fitted to the sewing machine 1, or is installed inside the sewing machine 1. The frame driving device 2 includes an X linear slider 21 that moves the embroidery frame 26 in an X-axis direction, and a Y linear slider 22 that moves the embroidery frame 26 in a Y-axis direction. The X-axis direction is a lengthwise direction of the bed unit 11, and is generally the right and left direction of the user, while the Y-axis direction is a widthwise direction of the bed unit 11, and is generally the back-and-forth direction of the user.

The X linear slider 21 has the Y linear slider 22 slidably provided on the rail extended in the X-axis direction, has the Y linear slider 22 orthogonally fastened relative to an endless belt that runs in the X-axis direction, drives the endless belt by an X-axis motor 23, and moves the Y linear slider 22 along the X-axis direction. The Y linear slider 22 has a embroidery frame arm 25 slidably provided on the rail extended in the Y-axis direction, has the embroidery frame arm 25 fastened to an endless belt that runs in the Y-axis direction, drives the endless belt by a Y-axis motor 24, and moves the embroidery frame arm 25 along the Y-axis direction.

The embroidery frame arm 25 is a support for the embroidery frame 26, and the embroidery frame 26 is attached to the tip of the embroidery frame arm 25 with the Y linear slider 22 being a base end. The embroidery frame 26 includes an inner frame and an outer frame, holds and fastens the sewing object 100 between the inner frame and the outer frame by fitting the outer frame to the inner frame which the sewing object 100 is placed on. The sewing object 100 is positioned on the plane of the bed unit 11 so as to be movable horizontally along the fastened planar direction by the frame driving device 2.

(Thread Cutting Mechanism)

As illustrated in FIG. 4, the thread cutting mechanism 17 is held in the interior of the bed unit 11 above the shuttle 14, and includes a movable blade 171 and a stationary blade 172. The movable blade 171 and the stationary blade 172 face with each other across the route for the needle thread 200 and the bobbin thread 300. The movable blade 171 comes close to and go apart from the stationary blade 172. When the movable blade 171 comes close to the stationary blade 172, the needle thread 200 and the bobbin thread 300 are cut by the movable blade 171 and the stationary blade 172.

(Control Device)

Figure 5:
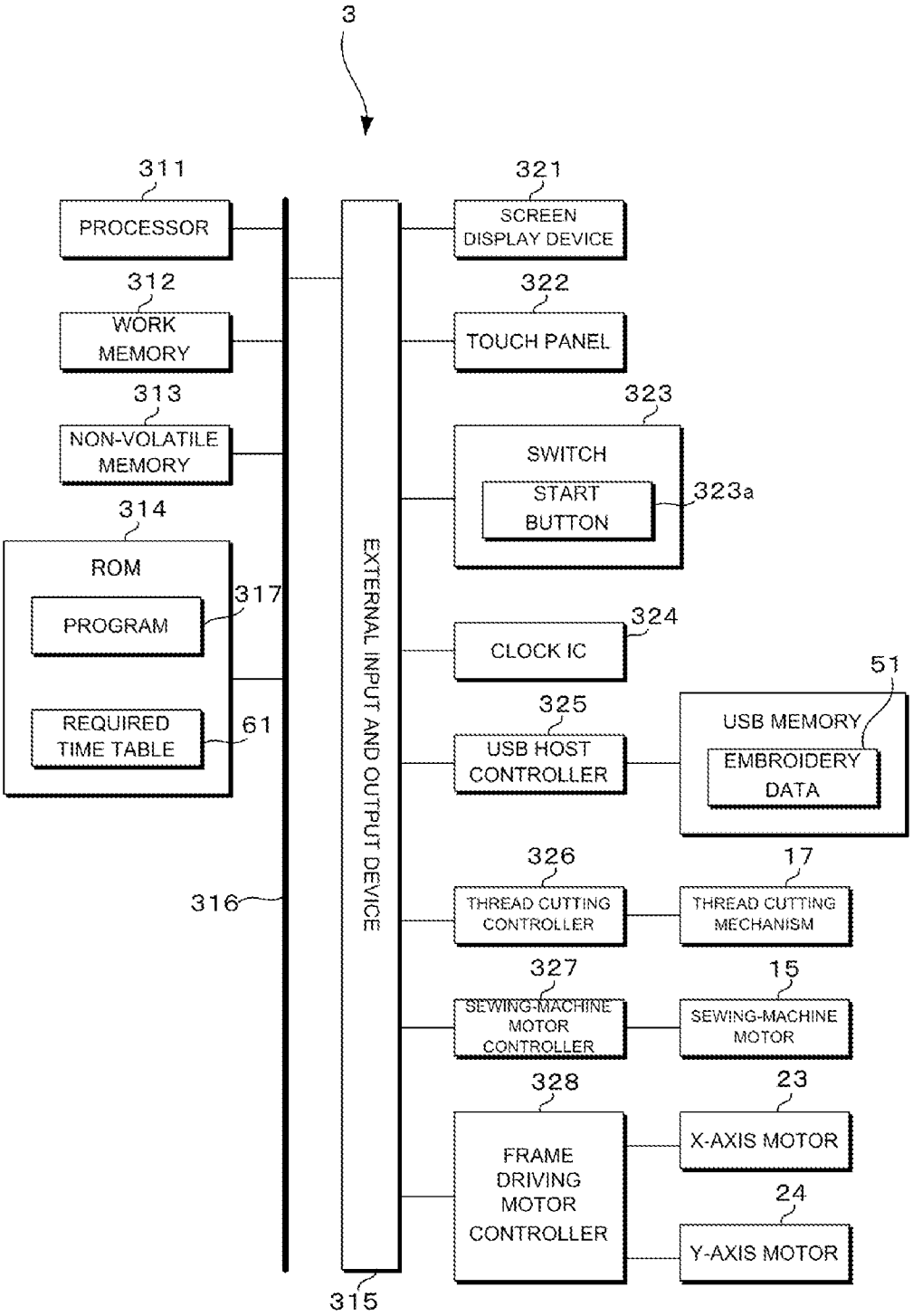
FIG. 5 is a block diagram illustrating a hardware configuration of a control device for the sewing machine.

As illustrated in FIG. 5, the sewing machine 1 includes a control device 3 that controls the sewing machine 1, the frame driving device 2, and the thread cutting mechanism 17. The control device 3 includes a so-called computer and a peripheral controller. This control device 3 includes a processor 311 such as a CPU, a work memory 312 such as a RAM, a non-volatile memory 313 such as an FROM, a ROM 314, and an external input and output device 315 such as an I/O port, and those are connected with each other via a bus 316. In addition, the control device 3 also includes a screen display device 321, a touch panel 322, a switch 323, a clock IC 324, a USB host controller 325, a thread cutting controller 326, a sewing-machine motor controller 327, and a frame driving motor controller 328, which are connected via the external input and output device 315.

The ROM 314 stores a program 317 for executing embroidery, and a required time table 61 beforehand. This ROM 314 loads the program 317 and the required time table 61 to the work memory 312 in accordance with a request from the processor 311. The USB host controller 325 has a port which a USB memory can be connected to. This USB host controller 325 controls the USB memory in accordance with a request from the processor 311, and loads embroidery data 51 to the work memory 312 from the USB memory.

The memory medium that holds the embroidery data 51 may be an SD card or a server over a network. The sewing machine 1 includes an SD card slot capable of reading the SD card, or a network adaptor capable of being connected with a network such as a LAN by wireless or wired scheme. The embroidery data 51 may be read from the SD card, or the embroidery data 51 may be downloaded from the server and may be loaded in the work memory 312.

The processor 311 executes, as appropriate, the program 317 developed in the work memory 312 with reference to the embroidery data 51 and the required time table 61 as appropriate. Next, the processor 311 outputs a control signal via the external input and output device 315 in accordance with the execution result of the program 317, and transmits and receives data to and from the non-volatile memory 313 via a bus 316. In addition, a user operation signal is input to the processor 311 by a request and an interruption via the touch panel 322, the switch 323, etc.

The screen display device 321 is a man-machine interface, such as a liquid crystal display or an organic EL display. This screen display device 321 displays display data transmitted by the processor 311 in a layout that can be visually understood by the user, such as letters and figures. The touch panel 322 is a pressure-sensitive or electrostatic type input device that transmits the signal to the processor 311 in accordance with the user's touch operation. The switch 323 is a physical input device that transmits the signal to the processor 311 in accordance with the user's button operation, and includes a start button 323*a* that instructs to start sewing.

The clock IC 324 is an integrated circuit that measures the present clock time, and transmits present clock time information to the processor 311. The thread cutting controller 326 is connected to the thread cutting device 17 via signal lines. This thread cutting controller 326 drives thread cutting mechanism 17 in response to the control signal from the processor 311.

The sewing-machine motor controller 327 is connected with the sewing-machine motor 15 via signal lines. In response to the control signal from the processor 311, this sewing-machine motor controller 327 rotates the sewing-machine motor 15 at a rotation speed indicated by the control signal, or deactivates the sewing-machine motor 15. The frame driving motor controller 328 is connected with the X-axis motor 23 and Y-axis motor 24 of the frame driving device 2 via signal lines. In response to the control signal from the processor 311, this frame driving motor controller 328 drives the X-axis motor 23 and the Y-axis motor 24 by the moving amount indicated by the control signal.

Figure 6:
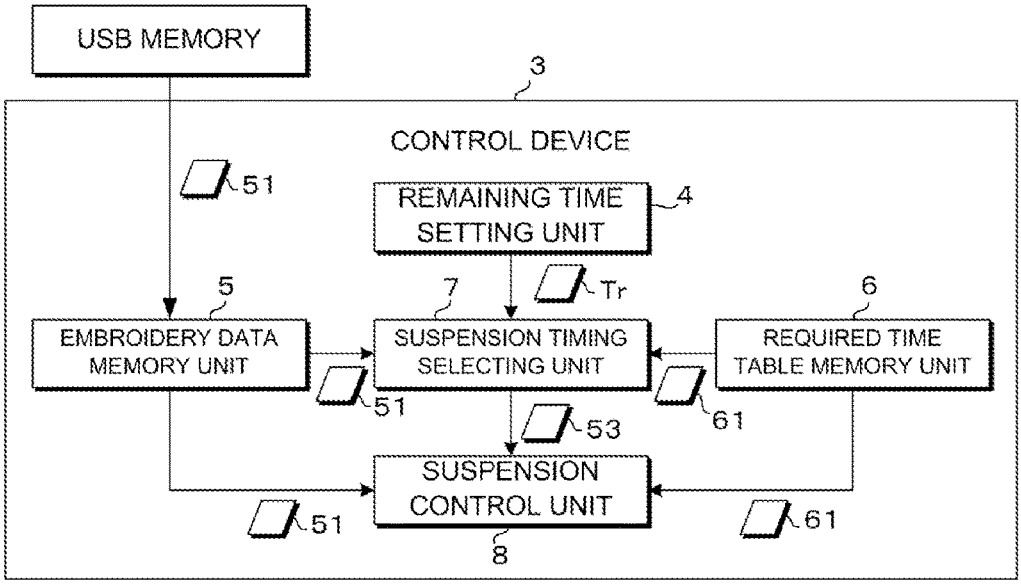
FIG. 6 is a block diagram illustrating a software configuration of the control device for the sewing machine.

FIG. 6 is a block diagram illustrating the details of the control device 3 achieved by execution of the program 317. As illustrated in FIG. 6, the control device 3 includes a remaining time setting unit 4, a embroidery data memory unit 5, a required time table memory unit 6, an suspension timing selecting unit 7, and an suspension control unit 8. The remaining time setting unit 4 mainly includes the touch panel 322, the processor 311, and the screen display device 321. The embroidery data memory unit 5 and the required time table memory unit 6 mainly includes the work memory 312. The suspension timing selecting unit 7 mainly includes the processor 311 and the screen display device 321. The suspension control unit 8 mainly includes the processor 311, the sewing-machine motor controller 327, the frame driving motor controller 328, the thread cutting controller 326, and the screen display device 321.

(Remaining Time Setting Unit)

The remaining time setting unit 4 sets a remaining time Tr. The remaining time Tr indicates a desired suspension timing of embroidery by the user by a time up to embroidery suspension. The planned suspension timing is a fixed timing regardless of the advancement of embroidery pattern, and remains unchanged even when the advancement of embroidery pattern is delayed or advanced. The planned suspension timing is input by the user operation given to the touch panel.

By the user operation given to the touch panel 322, the clock time of embroidery suspension desired by the user is input to the control device 3 as the planned suspension timing. The remaining time setting unit 4 subtracts the present clock time from the input suspension clock time, to convert the planned suspension timing indicated by the suspension clock time into the remaining time Tr. The present clock time may be received from the clock IC 324 at the time of calculation of the remaining clock time, or may be calculated based on the activation clock time received from the clock IC 324 at the time of activation of the sewing machine 1 and the CPU clock. The remaining time Tr may be directly input by the user operation given to the touch panel 322.

(Embroidery Data Memory Unit)

Figure 7:
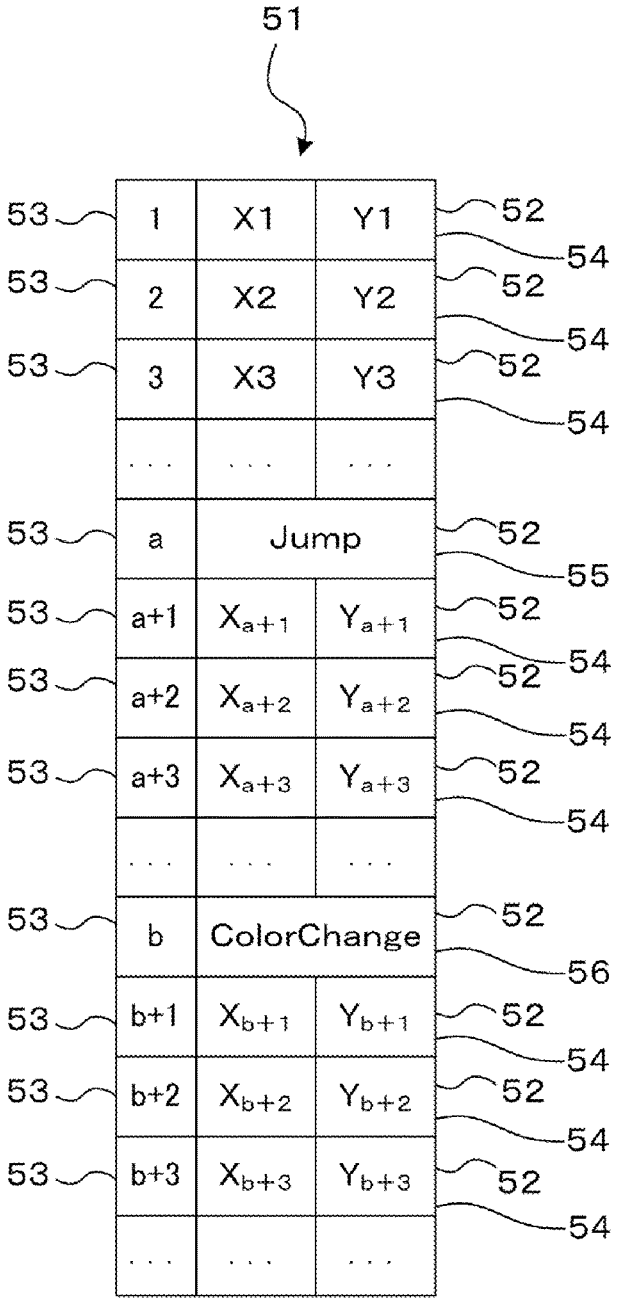
FIG. 7 is a schematic diagram of embroidery data.

The embroidery data 51 is loaded in the embroidery data memory unit 5. FIG. 7 is a schematic diagram of the embroidery data 51. The embroidery data 51 is a data row arranging statements 52 in sequence, and describes the operation sequence to form the embroidery pattern. That is, each statement 52 instructs the control detail by the control device 3. The statement 52 is frame moving amount information 54, a jump command 55, or a color change command 56. Each statement 52 has seam numbers 53 as a pair. The seam number 53 indicates the execution order of operation.

The frame moving amount information 54 indicates the moving amount of the embroidery frame 26. This frame moving amount information 54 is expressed by a X-axis direction moving amount and a Y-axis direction moving amount to move the embroidery frame 26. Since the frame moving amount information 26 is expressed by the X-axis direction moving amount and the Y-axis direction moving amount, this information can be clarified as indicating the movement of the embroidery frame 26, and a command is omitted. The processor 311 transmits the control signal that indicates the X-axis direction moving amount and the Y-axis direction moving amount to the frame driving motor controller 328 when executing the frame moving amount information 54. The frame driving motor controller 328 drives the X-axis motor 23 to satisfy the X-axis direction moving amount, drives the Y-axis motor 24 to satisfy the Y-axis direction moving amount, and the embroidery frame 26 in moved by the X-axis direction moving amount in the X-axis direction and by the Y-axis direction moving amount in the Y-axis direction.

The jump command 55 is a control command of the operation of moving the needle dropping position to the embroidery start point of the next pattern block. The embroidery pattern is formed by a combination of a plurality of the pattern blocks, and the sewing machine 1 transits to the sewing of the next pattern block after completing the sewing of the one pattern block. At this time, the seam located at the termination of one pattern block and the seam located at the start of the next pattern block are discontinuous, and are separated from each other with a distance.

For example, an embroidery pattern that has a character string ABC arranged horizontally in sequence below a heart marking includes a pattern block of the heart marking, and each pattern block of each alphabet. When sewing of the heart marking completes, the needle dropping position is relatively moved without connecting the termination of the heart marking with the start of the letter A, and sewing of the embroidery pattern for the letter A automatically resumes.

The color change command 56 is a control command of an operation of changing the colored thread when the embroidery is formed by a plurality of colors. As illustrated in FIG. 5, when executing the color change command 56, the processor 311 outputs the control signal that deactivates the sewing-machine motor 15 to the sewing-machine motor controller 327, stands by until the signal indicating the depression of the start button 323*a* by the user is input from the switch 323, and outputs the control signal indicating the driving of the sewing-machine motor 15 to the sewing-motor controller 327 when the signal indicating the depression of the start button 323*a* is input. During the suspension of the sewing-machine motor 15, the thread cutting mechanism 17 cuts the present thread, and the user changes the threads to the threads with the next color. Since the threads can be changed, the seams to be connected by the thread become discontinuous.

In the case of, for example, the embroidery pattern that has a black character string ABC arranged horizontally in sequence below the pink heart marking, after the embroidery of heart marking is sewn, the pink thread is cut, the threads are changed to the black threads, and sewing of the embroidery pattern from the letter A is resumed. The pink thread is not connected with the black thread, and the seam formed by the pink threads and the seam formed by the black threads are not connected by the same thread being discontinuous.

(Required Time Table Memory Unit)

The required time table 61 is loaded in the required time table memory unit 6. FIG. 8 is a schematic diagram illustrating the required time table 61. The required time table 61 stores required time information 63 and rotation speed information 64 of the sewing-machine motor 15 relative to various moving amount information 62 of the embroidery frame 26. In addition, each required time information 63 and the rotation speed information 64 of the sewing-machine motor 15 relative to the jump command 65 and the color change command 66 are also stored.

The moving amount information 62 stored in the required time table 61 is the larger one between the X-axis direction moving amount and the Y-axis direction moving amount of the embroidery frame 26. This is because the X-axis motor 23 and the Y-axis motor 24 are simultaneously driven at the same speed so that the required time to move the embroidery frame 26 is rate-limited to the larger one between the moving amount in the X-axis direction and the moving amount in the Y-axis direction. The processor 311 obtains the required time from the required time table 61 the larger one between the X-axis direction moving amount and the Y-axis direction moving amount in the frame moving amount information 54 of the embroidery data 51 as a search key.

In addition, the required time information 63 relative to the jump command 65 indicates a time required for from the deactivation of the sewing-machine motor to the resuming thereof across the movement of the embroidery frame to transition to the next pattern block. For example, the required time information 63 relative to the jump command 65 is 0.7 to 0.8 seconds. The required time information 63 relative to the color change command 66 is an estimated required time that is the completion of the color changing from the deactivation of the sewing-machine motor 15 to the depression of the start button 323*a* in view of an estimated time for changing the threads with different colors by the user. For example, the required time for the color change command 66 is 2 minutes in default. The rotation speed information 64 indicates the rotation speed of the sewing-machine motor 15.

(Suspension Timing Selecting Unit)

The suspension timing selecting unit 7 refers to the remaining time Tr, the embroidery data 51, and the required time table 61, detects the specific operation of the sewing machine 1 suitable for the suspension near the planned suspension timing at which the remaining time Tr has elapsed in time series, and selects one specific operation suited for the conditions from the detected specific operation suitable for the suspension. The specific action suitable for the suspension is desirably an action that discontinues seams (hereinafter, referred to as a discontinuous operation), and example discontinuous actions are a jump operation of the pattern block with respect to the jump command 55, and a color changing operation with respect to the color change command 56.

This suspension timing selecting unit 7 accumulates the required time for each operation from the sewing start to the discontinuous operation, calculates the timing of the discontinuous operation, and determines whether the discontinuous operation timing is near the planned suspension timing or not. Next, the suspension timing selecting unit 7 selects the discontinuous operation nearest to the planned suspension timing among the discontinuous operations arranged in time series near the planned suspension timing. The condition in this case is nearest.

As for the accumulation of the required time, regardless of the moving amount of the embroidery frame 26, in a case each seam forming operation is in a constant time, the timing of the discontinuous operation can be obtained in the formed of elapse time by multiplying the number of formed seams until the discontinuous operation with the constant time. In addition, the rotation speed of the sewing-machine motor 15 in a predetermined number of operations may be subjected to rate-limiting relative to the operation with the largest moving amount among the predetermined number of sequential operations. In this case, when the required time of the operation that requires the largest time among the predetermined number of operations is multiplied by the number of operations to obtain the timing of discontinuous operation in the form of elapse time. For example, when the plurality of operations foreseen beforehand contains the stitch formation by four processes and the color changing by one process, the required time corresponding to the rotation number of the sewing-machine motor 15 at the time of color change is obtained from the required time table 61, and this required time is multiplied by the number of operations that is the five processes foreseen beforehand.

Figure 9:
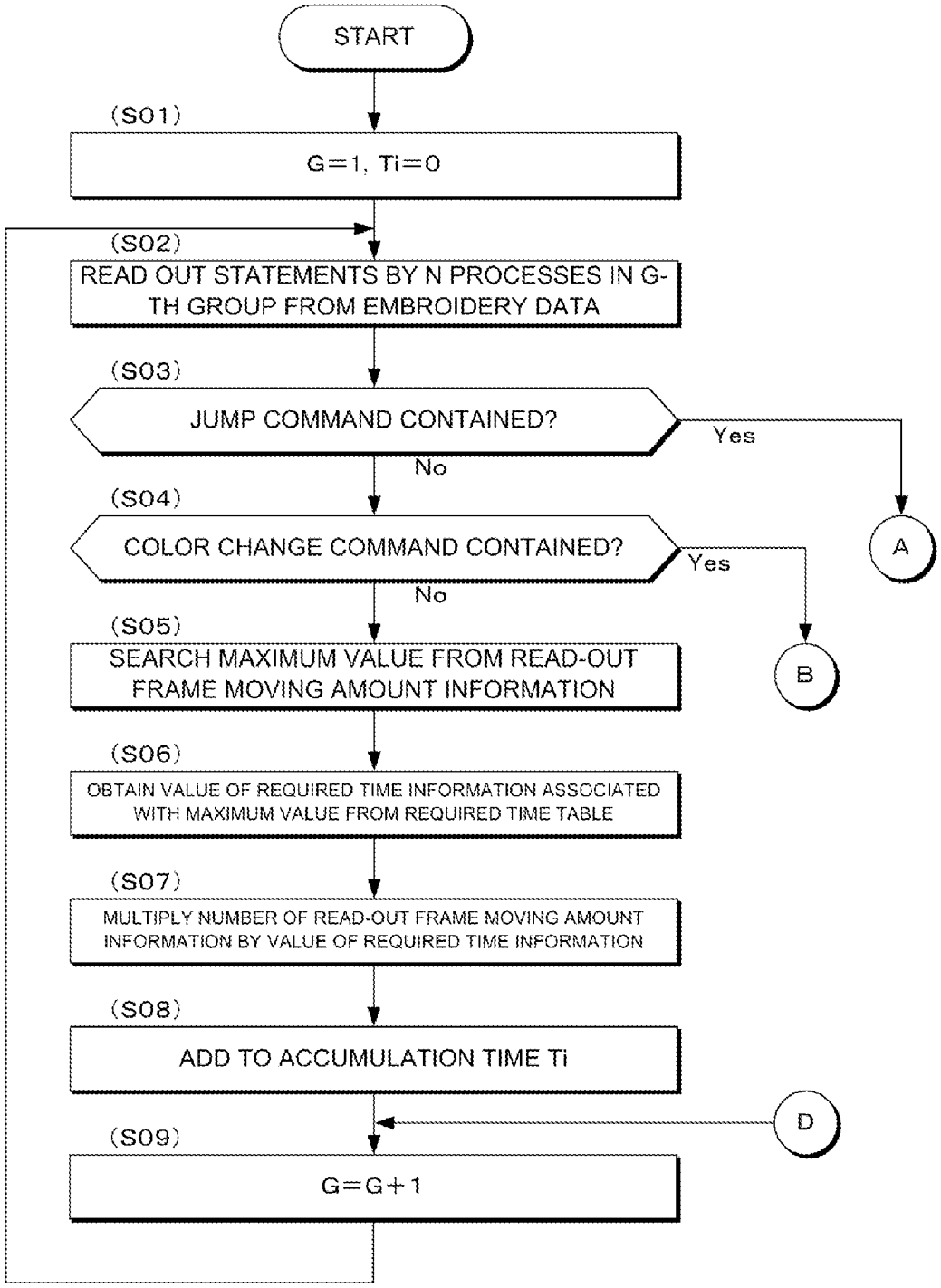
FIG. 9 is a flowchart illustrating a first procedure of a selecting operation of a suspension timing.

FIGS. 9 to 12 are each a flowchart illustrating an example operation of the suspension timing selecting unit 7. As illustrated in FIG. 9, the suspension timing selecting unit 7 initialized to a read-out order G=1, and an accumulation time Ti=0 (step S01). After the initialization, the suspension timing selecting unit 7 reads out the statement 52 of N number of processes in the G-th group from the initial process order from the embroidery data 51 (step S02). N is the number of processes, and for example, the statement 52 of five processes is read out from the embroidery data 51. Hence, the statements 52 from the (5×G−4)-th seam number 53 to the (5×G)-th seam number 53 are read out.

The suspension timing selecting unit 7 searches whether the jump command 55 and the color change command 56 are contained in the read-out statement 52 group or not (step S03 and step S04). The jump command 55 and the color change command 56 are example commands which have control details for a discontinuous operation with a discontinuity of seams.

When the read-out statement 52 group does not contain the jump command 55 and the color change command 56 (step S03: NO, and step S04: NO), the suspension timing selecting unit 7 searches the maximum value from all X-axis direction moving amount and all Y-axis direction moving amount of the read-out frame moving amount information 54 of the N number of processes (step S05).

When the maximum value is decided, the suspension timing selecting unit 7 obtains, from the required time table 61, the value of the required time information 63 associated with the moving amount information 62 to which this maximum value is belonged (step S06). Next, the value N that is consistent with the number of the read-out frame moving amount information 54 is multiplied by the value of the required time information 63 (step S07), and the multiplication result is added to the accumulation time Ti (step S08).

Next, the read-out order G is incremented by 1 (step S09), and the process returns to reading out of the statements 52 from the embroidery data 51 (step S02).

The reason why the statements 52 of N number of processes is read out is to perform rate limiting on the rotation speed of the sewing-machine motor 15 of when performing the statements 52 by N number of processes with the operation of moving the embroidery frame 26 by the maximum moving amount, the jump operation, or the color changing operation among the operations of N number of processes. That is, the number N may be an integer equal to or greater than 1 in accordance with the specification of the sewing machine 1. When, for example, the operation speed of the sewing machine 1 is changed for each process, it is appropriate that N=1.

Figure 10:
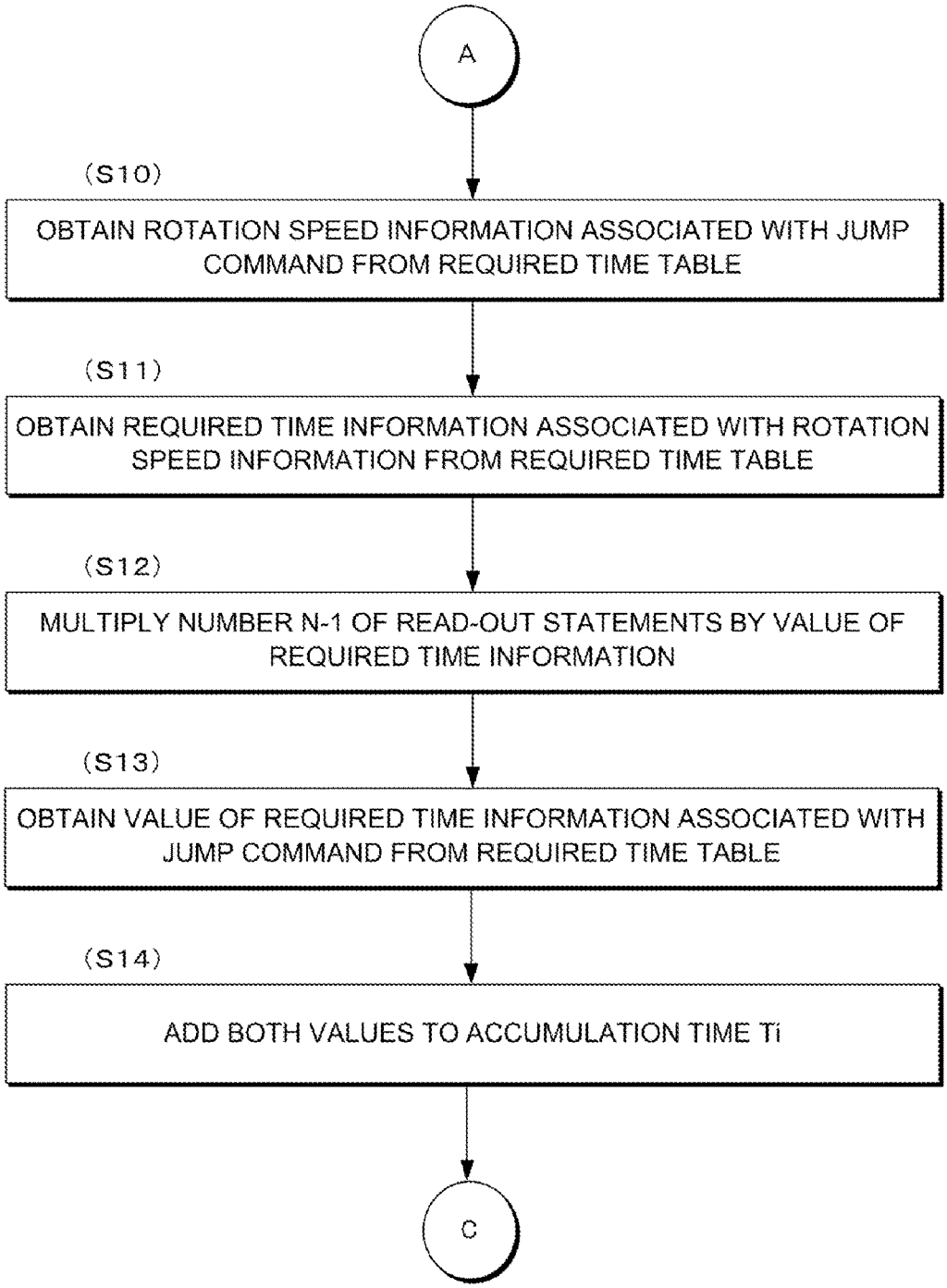
FIG. 10 is a flowchart illustrating a second procedure of the selecting operation of the suspension timing.

When the read-out statement 52 group contains the jump command 55 (step S03: YES), as illustrated in FIG. 10, the rotation speed information 64 associated with the jump command 65 is obtained from the required time table 61 (step S10), and the required time information 63 associated with the obtained rotation information 64 is obtained from the required time table 61 (step S11). Next, the value N−1, which is obtained by subtracting 1 from the number of the read-out statements 52, is multiplied by the value of the required time information 63 (step S12), the value of the required time information 63 associated with the jump command 65 is also obtained from the required time table 61 (step S13), and both values are respectively added to the accumulation time Ti (step S14).

Figure 11:
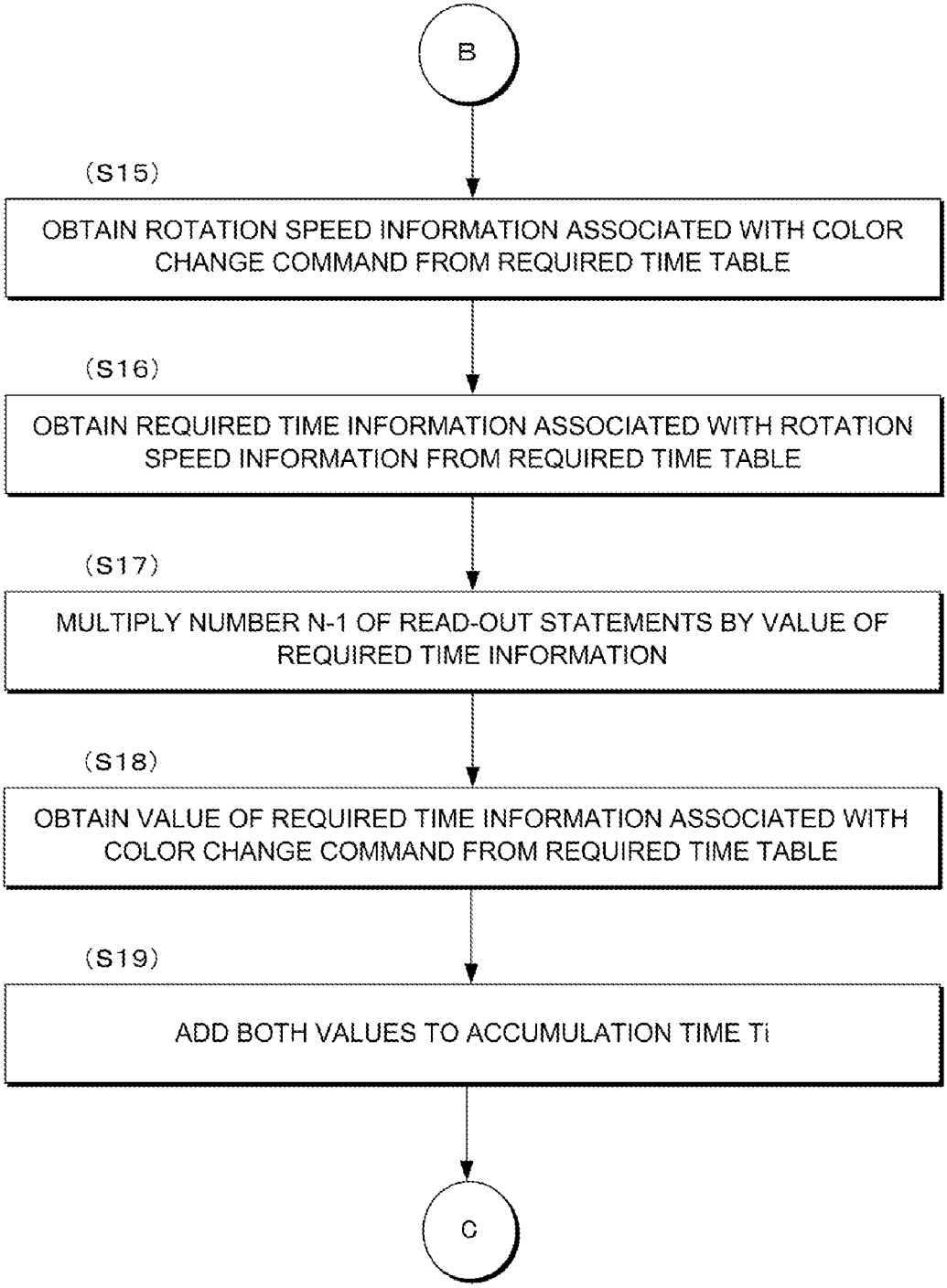
FIG. 11 is a flowchart illustrating a third procedure of the selecting operation of the suspension timing.

When the read-out statement 52 group contains the color change command 56 (step S04: YES), as illustrated in FIG. 11, the rotation speed information 64 associated with the color change command 66 is obtained from the required time table 61 (step S15), and the required time information 63 associated with the obtained rotation speed information 64 is obtained from the required time table 61 (step S16) Next, the value N−1, which is obtained by subtracting 1 from the number of the read-out statements 52, is multiplied by the value of the required time information 63 (step S17), the value of the required time information 63 associated with the color change command 66 is obtained from the required time table 61 (step S18), and both values are respectively added to the accumulation time Ti (step S19).

Figure 12:
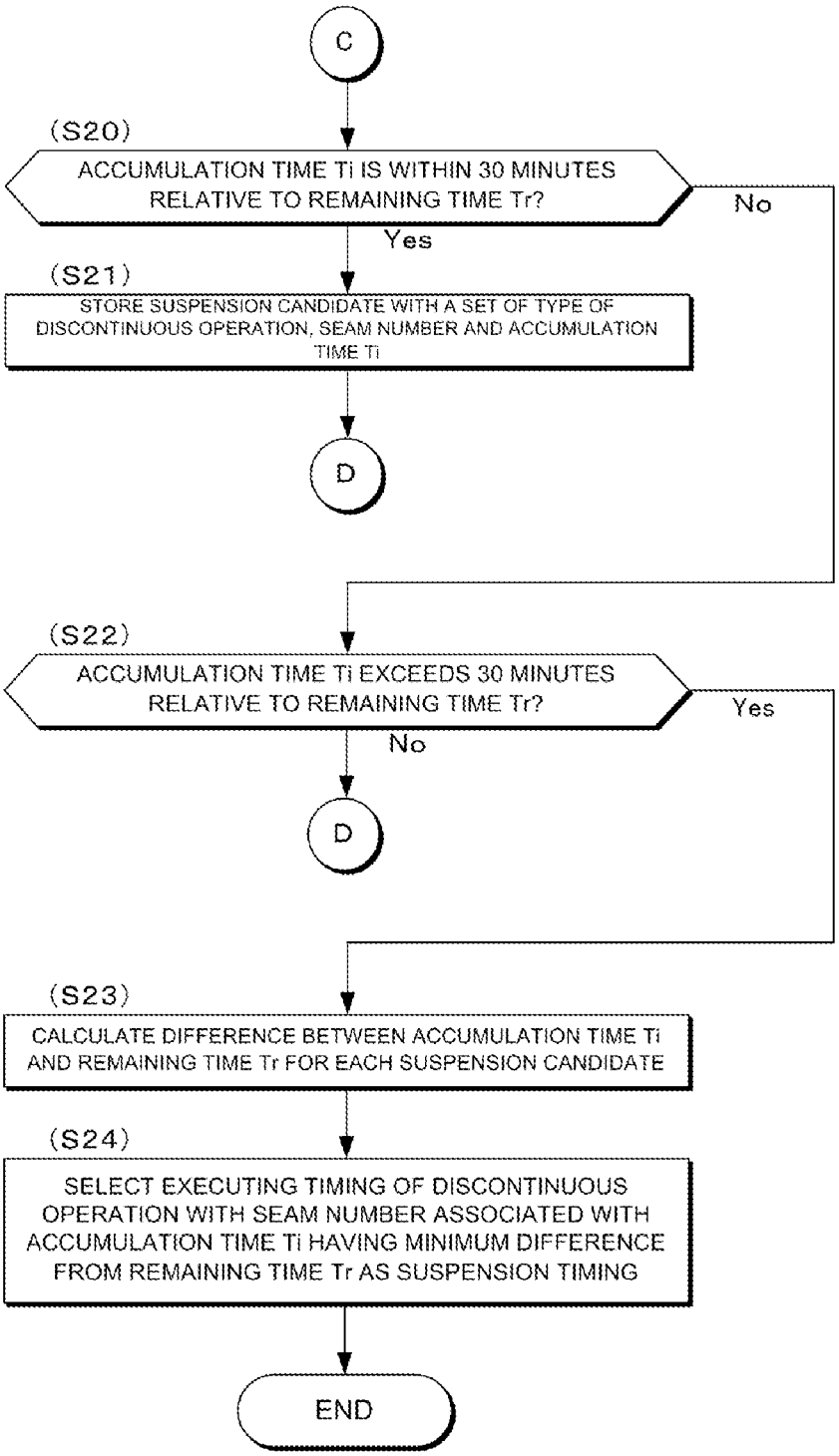
FIG. 12 is a flowchart illustrating a fourth procedure of the selecting operation of the suspension timing.

When the jump command 55 or the color change command 56 are contained (step S03: YES or step S04: YES), after the update process of the accumulation time Ti (step S14, step S19), as illustrated in FIG. 12, the accumulation time Ti and the remaining time Tr are compared with each other (step S20). This accumulation time Ti is the discontinuous operation timing, and is the suspension timing. The remaining time Tr is the planned suspension timing with reference to the sewing start of the embroidery pattern.

When the accumulation time Ti is equal to or less than 30 minutes relative to the remaining time Tr (step S20: YES), the type of the read-out jump command 55 or the read-out color change command 56 is combined with the seam number and the accumulation time Ti, and is registered as a suspension candidate (step S21). That is, the discontinuous operation near the planned suspension timing is detected, the execution timing thereof is associated with the type of the detected discontinuous operation and the seam number 53 of the detected discontinuous operation, and stored in the suspension candidate area secured in the work memory 312.

Next, the read-out order G is incremented by 1 (step S09), and the process returns to reading out of the statements 52 from the embroidery data 51 (step S02). In addition, when the accumulation time Ti has a difference equal to or greater than 30 minutes relative to the remaining time Tr (step S20: No), and when the accumulation time Ti is less than over 30 minutes relative to the remaining time Tr (step S22: NO), the read-out order G is incremented by 1 (step S09), and the process returns to the reading out of the statements 52 (step S02). According to this process, when the discontinuous operation is not within 30 minutes before or after the planned suspension timing, the operation is too far from the planned suspension timing, and is not set as the suspension timing. 30 minutes are merely an example, and the present disclosure is not limited to this example.

Conversely, when the accumulation time Ti has a difference equal to or greater than 30 minutes relative to the remaining time Tr (step S20: NO), and the accumulation time Ti has exceeds the remaining time Tr for over 30 minutes (step S22: YES), the difference between each accumulation time Ti registered as the candidate and the remaining time Tr is calculated (step S23). Next, the seam number 53 associated with the accumulation time Ti that has the minimum difference from the remaining time Tr is stored in a suspension timing variable (step S24).

That is, after 30 minutes from the suspension timing, the search for the discontinuous operation is terminated because there is no timing that can be set as the suspension timing, and the discontinuous operation that has the suspension timing nearest to the planned suspension timing is selected among the detected discontinuous operations, and the execution timing of this discontinuous operation is set as the suspension timing. The suspension timing variable is information that indicates the discontinuous operation determined as the suspension timing.

(Suspension Control Unit)

When the process order reaches the selected discontinuous operation, the suspension process is executed after the selected discontinuous operation has completed. The suspension process is a suspension of the sewing-machine motor 15 and the frame driving device 2, informing the user of the incoming suspension timing, storing the embroidery data 51 and the next seam number 53 in the non-volatile memory 313, and standing by for the depression of the start button 323*a* of the switch 323.

As for the information to the user of the incoming suspension timing, for example, a character string that indicates the incoming of the suspension timing is displayed on the screen display device 321, sounds that indicates the incoming of the suspension timing are generated if a speaker is provided, and a character string that indicates the incoming of the suspension timing is displayed on a mobile terminal such as a smartphone of the user when a communication interface capable of being connected with the LAN or the Internet is provided.

In addition, the suspension control unit 8 performs a resuming processing to resume embroidery. That is, the suspension control unit 8 loads the embroidery data 51 and the next seam number 53 to the work memory 312 from the non-volatile memory 313 in response to the depression of the start button 323*a*. The sewing machine 1 resumes embroidery with reference to the embroidery data 51 from the loaded seam number 53.

Figure 13:
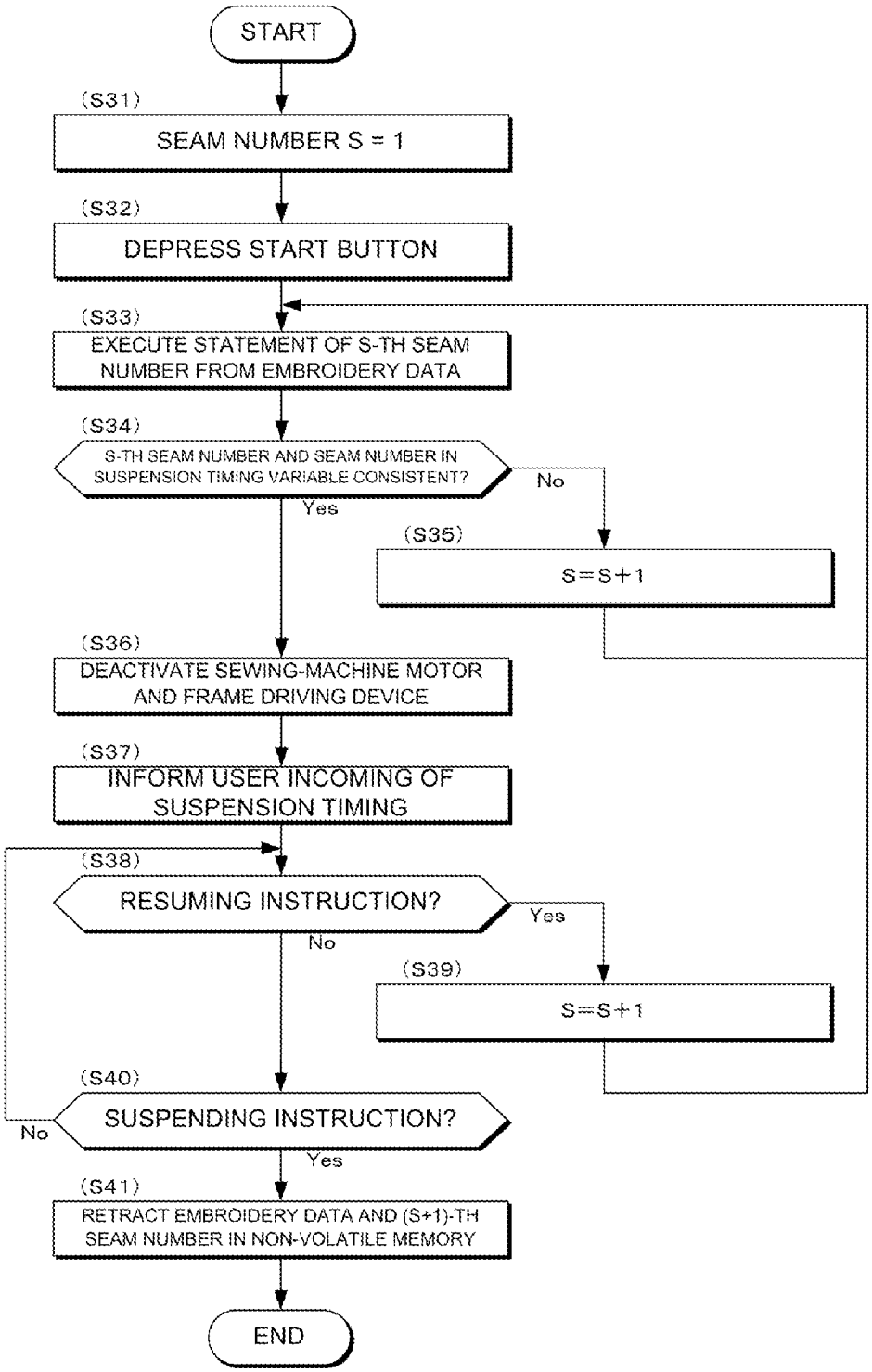
FIG. 13 is a flowchart illustrating an operation of suspension control.

FIG. 13 is a flowchart illustrating a suspending operation by the suspension control unit 8. As illustrated in FIG. 13, the control device 3 initializes a seam number S=1 (step S31), and when the start button 323*a* of the switch 323 is depressed (step S32), the statement 52 of the S-th seam number in the embroidery data 51 is executed (step S33).

When the frame moving amount information 54 is executed, the control device 3 drives the X-axis motor 23 to move the embroidery frame 26 by the X-axis direction moving amount in the moving amount information 54, and drives the Y-axis motor 24 to move the embroidery frame 26 by the Y-axis direction moving amount in the moving amount information 54. In addition, the rotation speed of the sewing-machine motor 15 is changed with reference to the frame moving amount information 54 and the required time table 6.

As for the jump command 55, the control device 3 deactivates the sewing-machine motor 15, drives the X-axis motor 23 and the Y-axis motor 24, and moves the embroidery frame to position the needle on the next embroidery block. As for the color change command 56, the control device 3 deactivates the sewing-machine motor 15, drives the thread cutting mechanism 17 to cut the threads, and stands by until the threads are changed and the start button 323*a* of the switch 323 is depressed.

The suspension control unit 8 compares the S-th seam number 53 in the embroidery data 51 with the seam number 53 stored in the suspension timing variable (step S34). Based on the comparison, when the S-th seam number 53 in the embroidery data 51 and the seam number 53 stored in the suspension timing variable are inconsistent (step S34: NO), the seam number S is incremented by 1 (step S35), and the process returns to the statement execution in the step S33.

In contrast, based on the comparison, when the S-th seam number 53 in the embroidery data 51 and the seam number 53 stored in the suspension timing variable are consistent (step S34: YES), the suspension control unit 8 deactivates the sewing-machine motor 15 and the frame driving device 2 (step S36). In addition, the suspension control unit 8 informs the user the incoming of the suspension timing (step S37).

When a resuming instruction is received via the touch panel 322 (step S38: YES), the seam number S is incremented by 1 (step S39), and embroidery is resumed from the statement 52 of the S-th seam number 53 in the embroidery data 51 (step S33). At this time, the start button 323*a* of the switch 323 may be forcibly depressed. Subsequently, the suspension control unit 8 is terminated, and sewing of the embroidery pattern without a monitoring of suspension timing is performed.

In addition, when a suspending instruction is received via the touch panel 322 (step S40), the suspension control unit 8 stores the embroidery data 51 and the (S+1)-th seam number 53 in the non-volatile memory 313 (step S41). That is, a status capable of resuming is established. Next, the user may shut off the power of the sewing machine 1.

Figure 14:
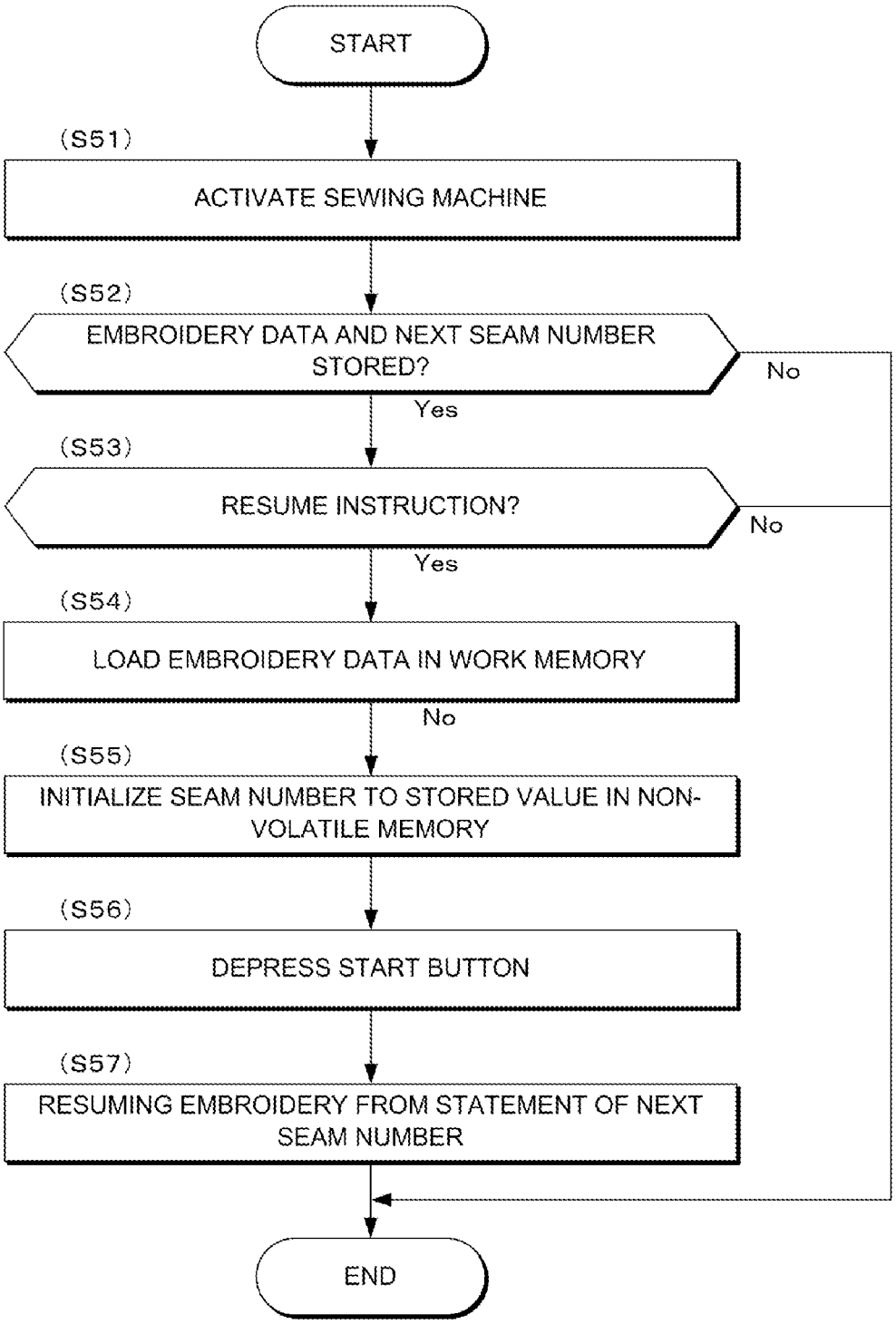
FIG. 14 is a flowchart illustrating an operation of resuming the sewing of a embroidery pattern.

FIG. 14 is a flowchart illustrating a resuming operation of the suspension control unit 8. When the sewing machine 1 is activated (step S51), the suspension control unit 8 checks whether the embroidery data 51 and the next seam number 53 are stored or not (step S52). Typically, the address at which the embroidery data 51 and the next seam number 53 are stored is requested to the non-volatile memory 313, and it is checked whether the received data is the embroidery data 51 and the seam number 53 or not.

When the embroidery data 51 and the seam number 53 are stored in the non-volatile memory 313 (step S52: YES), and when there is a resume instruction by the user operation (step S53: YES), the embroidery data 51 is loaded in the work memory 312 (step S54), and the seam number S is initialized to the value stored in the non-volatile memory 313 (step S55).

Subsequently, the operation of the suspension control unit 8 is terminated, and when the start button 323*a* of the switch 323 is depressed (step S56), the control device 3 resumes embroidery from the statement 52 with the S-th seam number 53 in the embroidery data 51 (step S57). In addition, when the embroidery data and the next seam number are not stored (step S52: NO), and when there is no resume instruction (step S53: NO), the operation of the suspension control unit 8 is also terminated.

(Action)

Figure 15:
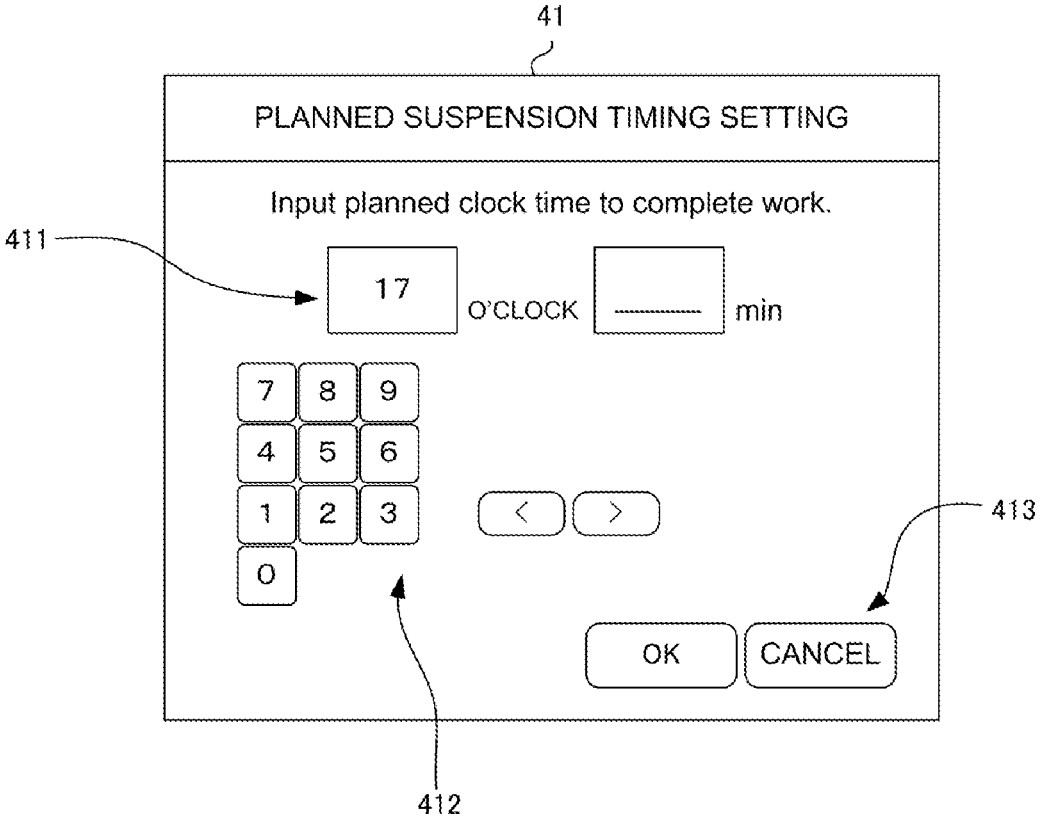
FIG. 15 is a schematic diagram illustrating a suspension setting screen.

An actual example of the sewing machine 1 will be described. The remaining time setting unit 4 creates a planned suspension timing setting screen 41 that accepts the input of the remaining time, and displays the screen on the screen display device 321. FIG. 15 is a schematic diagram illustrating the planned suspension timing setting screen 41. As illustrated in FIG. 15, the planned suspension timing setting screen 41 has a layout that includes a suspension clock time input area 411 to input hour and minute, a dial area 412 where the number keys are arranged, and a decision input area 413 to select whether to decide or cancel the input details.

When the user touches the number key of the dial area 412, the remaining time setting unit 4 displays the suspension clock time in accordance with the number keys in the suspension clock time input area 411. When the user touches a decision key in the decision input area 413, the remaining time setting unit 4 calculates the remaining time Tr from the displayed suspension clock time and the present time. When, for example, the present time is 2:00 p.m. and the suspension clock time is 5:00 p.m., the remaining time Tr that is 3 hours is obtained, and the remaining time setting unit 4 sets 3 hours in the remaining time variable. Hence, the planned suspension timing is set to be a time three hours later or at 5:00 p.m.

Figure 16:
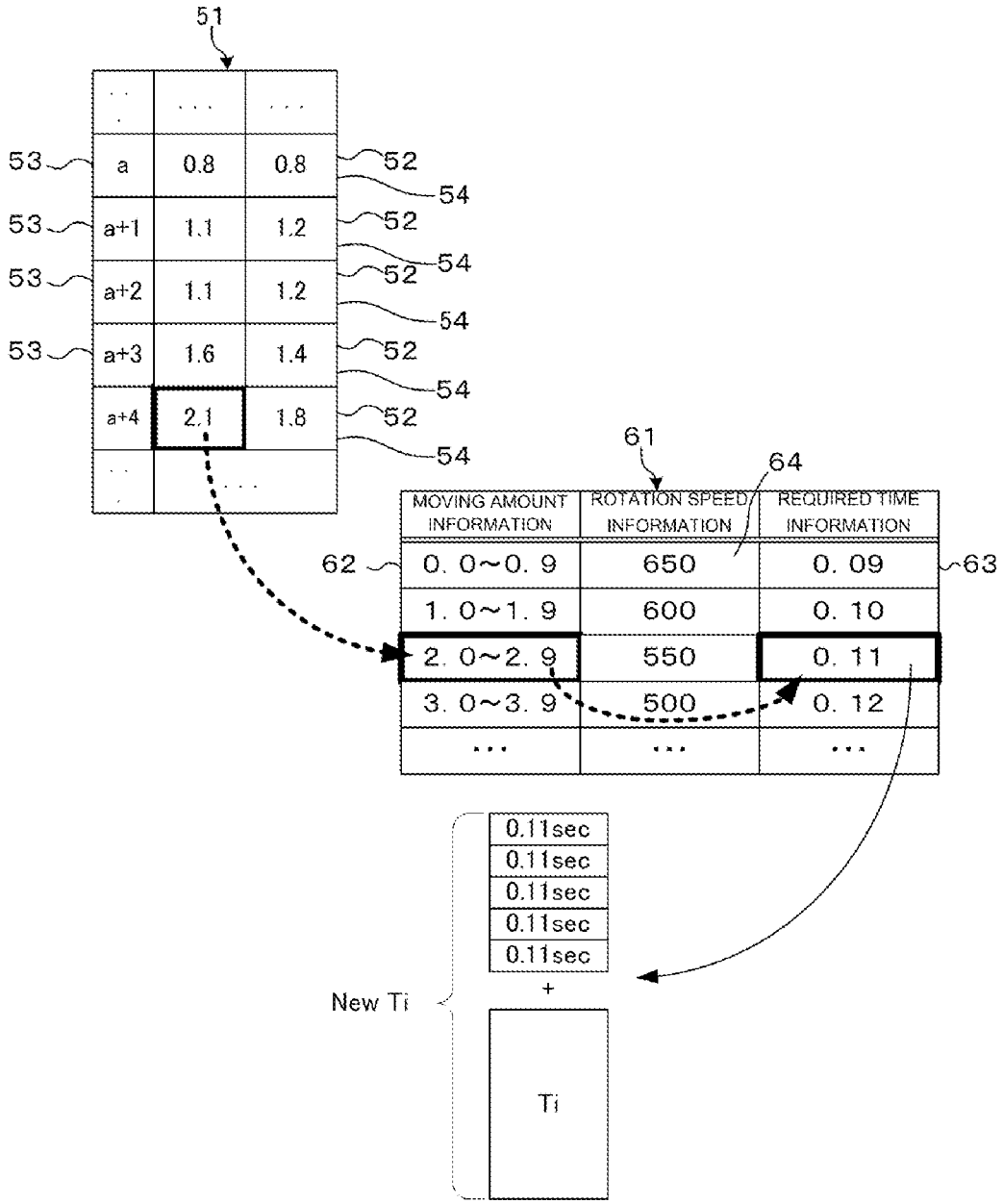
FIG. 16 is an explanatory diagram illustrating a part of a specific selection procedure of the suspension timing.

As illustrated in FIG. 16, the suspension timing selecting unit 7 extracts, for example, "2.1 mm" that is the largest value from the frame moving amount information 54 of the five processes from the seam number a to the seam number a+4, obtains the required time information 63 of "0.11 seconds" combined with the moving amount information 62 which "2.1 mm" is belonged from the required time table 61, and adds the quintuple value of the required time "0.11 second" to the accumulation time Ti. Simultaneously with the calculation of the accumulation time Ti, the suspension timing selecting unit 7 searches for the suspension candidate. There is no discontinuous operation in the seam numbers a+1 to a+4.

Figure 17:
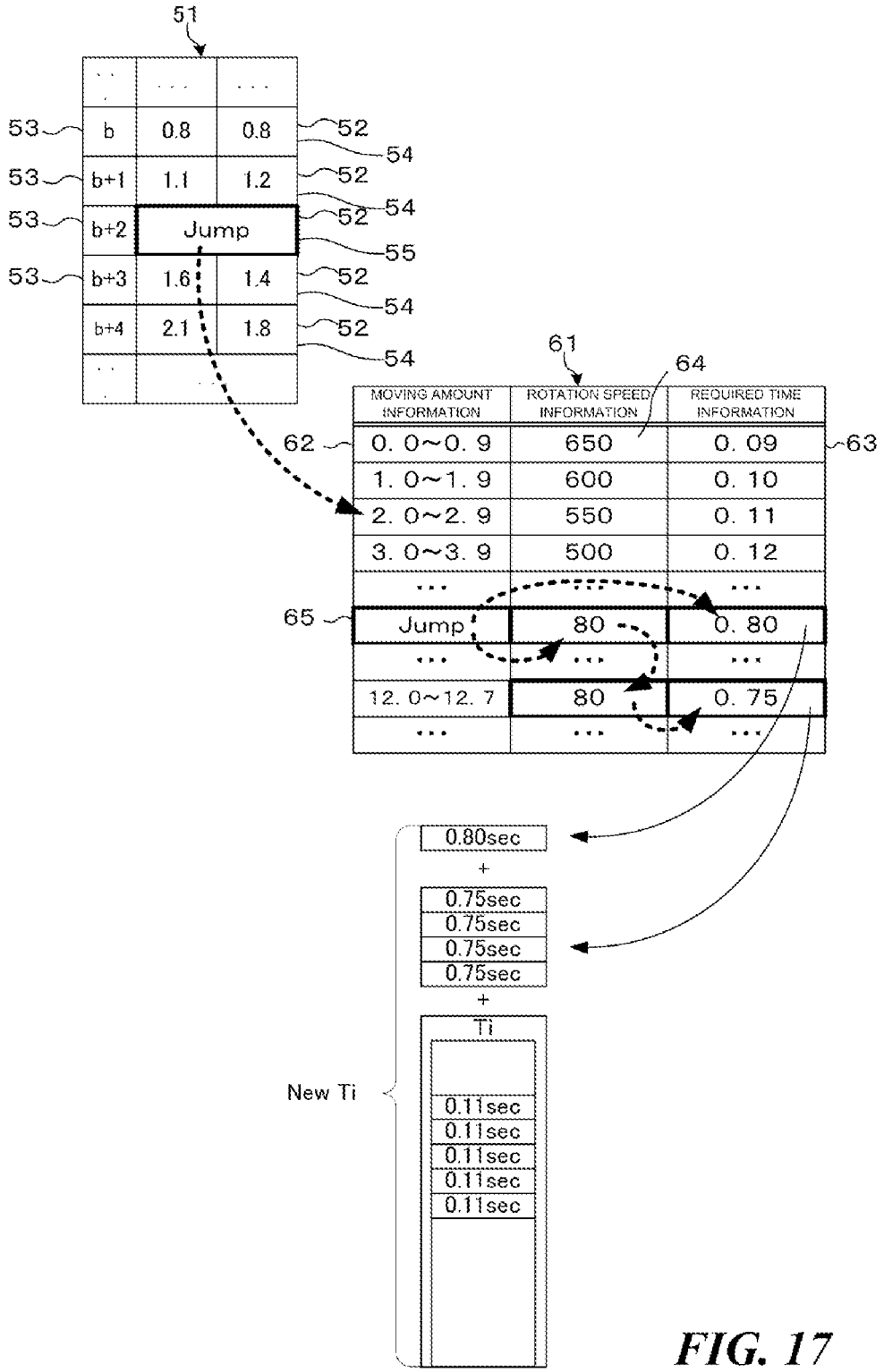
FIG. 17 is an explanatory diagram illustrating another part of a specific selection procedure of the suspension timing.

As illustrated in FIG. 17, the suspension timing selecting unit 7 finds the jump command 55 from, for example, the statements 52 of the five processes from the seam number b to the seam number b+4. The rotation speed information 64 that is "80 rpm" combined with the jump command 65 is obtained from the required time table 61, the required time information 63 that is "0.75 seconds" combined with the rotation speed information 64 that is "80 rpm" is obtained, and the quadruple value of the required time that is "0.75 seconds" is added to the accumulation time Ti. In addition, the required time information 63 that is "0.80 seconds" combined with the jump command 65 is obtained from the required time table 61, and the required time that is "0.80 seconds" is added to the accumulation time Ti.

Since the jump command 55 that instructs the discontinuous operation is found, the suspension timing selecting unit 7 compares the accumulation time Ti with the remaining time Tr that is "3 hours". When the accumulation time Ti indicating the timing at which the jump command 55 is executed is within 30-minute relative to the remaining time Tr that is "3 hours", that is, when the accumulation time Ti is equal to or greater than 2 hour and 30 minutes and equal to or smaller than 3 hour and 30 minutes, the execution timing of this jump command 55 is set as the candidate for the suspension timing. When the difference exceeds 30 minutes, since it is too different from the planned suspension timing desired by the user, the execution timing of this discontinuous operation is taken out from the candidate for the suspension timing.

Figure 18:
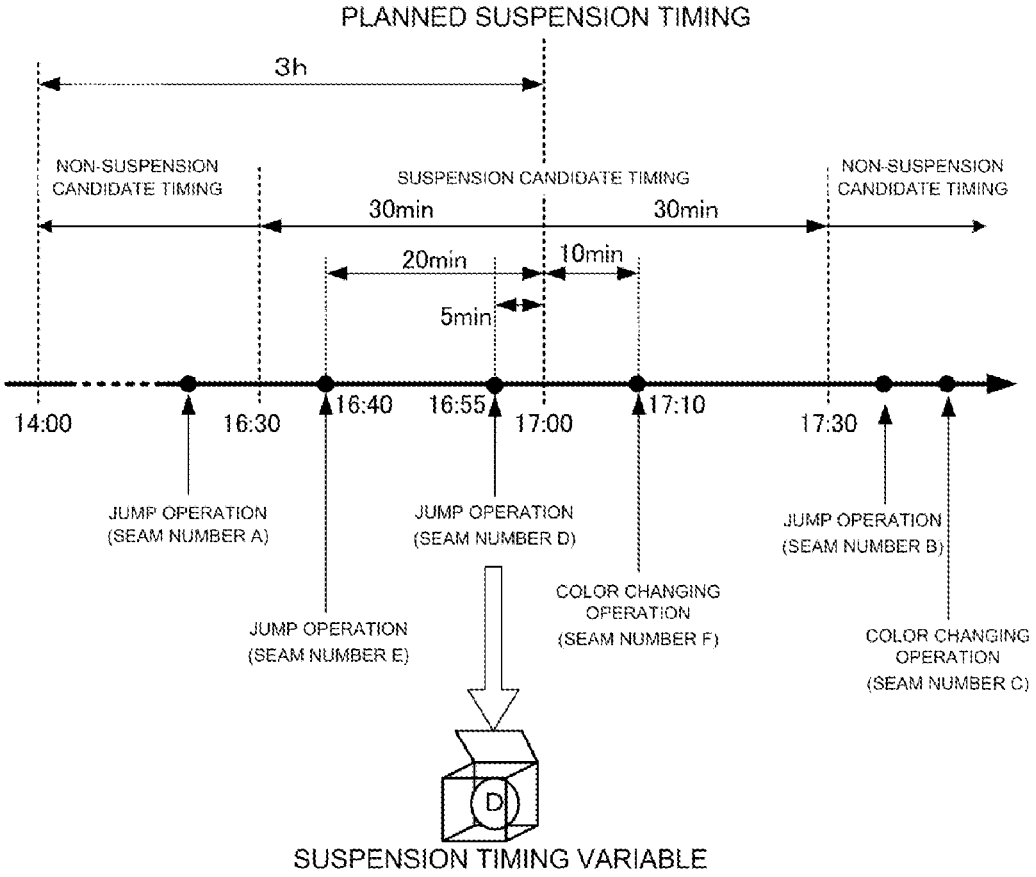
FIG. 18 is a time-series diagram illustrating a time relation between a planned suspension timing and a candidate of the suspension timing.

As illustrated in FIG. 18, in the embroidery pattern formation schedule, the timing of the jump operation and the timing of the color changing operation are positioned before and after the elapse timing of the remaining time Tr that is "5:00 p.m.". The execution timings of the jump operation (seam number A and seam number B) and the execution timing of the color changing operation (seam number C) at the time before 4:30 p.m. and after 5:30 p.m. are taken out from the candidate for the suspension timing.

In contrast, the execution timings of the jump operation (seam number D and seam number E) and the execution timing of the color changing operation (seam number F) positioned "after 4:30 p.m. and before 5:30 p.m." become the candidate for the suspension timing. Among those candidates for the suspension timing, the jump operation scheduled at 4:55 p.m. has the accumulation time Ti that is 2 hour and 55 minutes, and has the difference that is five minutes from the remaining time Tr that is 3 hours, nearest to 5:00 p.m.

Accordingly, the execution timing of the jump operation scheduled at 4:55 p.m. is set as the suspension timing, and during the sewing of the embroidery pattern, when the order of this jump operation comes, the sewing-machine motor 15 is deactivated. Next, the suspension control unit 8 informs the user the incoming of suspension timing.

Figure 19:
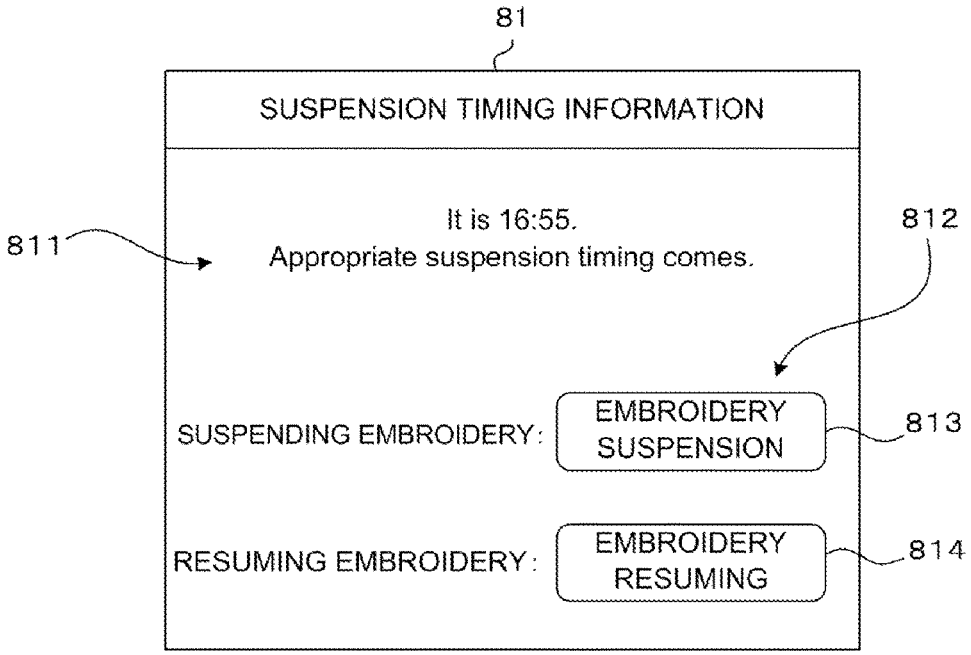
FIG. 19 is a schematic diagram illustrating a suspension timing informing screen.

FIG. 19 is a schematic diagram of a suspension timing informing screen. The suspension control unit 8 displays the suspension timing informing screen 81 on the screen display device 321, and informs the user the incoming of suspension timing. The suspension timing informing screen 81 has a layout that includes an informing area 811 and an operation area 812. The informing area 811 indicates, by character strings, that the present clock time is five minutes before designated 5:00 p.m., and that this is a suitable timing for suspension. The operation area 812 displays a suspension button 813 and a resuming button 814.

When the suspension button 813 is depressed, sewing is suspended, the embroidery data 51 and the next seam number 53 are stored in the non-volatile memory 313, and the power of the sewing machine 1 is shut down. When the sewing resuming button 814 is depressed, the monitoring of the suspension timing is terminated, and the sewing of the embroidery pattern is resumed.

After inputting the timing at which the user desires the suspension to the sewing machine 1, the user can concentrate on the sewing until the suspension timing comes without paying attention to an appropriate timing for suspension. That is, it is unnecessary for the user, at a time near 5:00 p.m., to compare in the user's mind the advancement of the embroidery pattern with the expected embroidery pattern when finished, and to predict an appropriate timing near 5:00 p.m. based on an experience and an intuition. In addition, it is also unnecessary for the user to suspend the sewing at 5:00 p.m. making in mind of the advancement of the embroidery being worse.

(Effect)

As described above, the sewing machine 1 according to this embodiment includes the input unit such as a touch panel 322, and the control device 3 that includes the embroidery data memory unit 5, the suspension timing selecting unit 7, and the suspension control unit 8. The input unit accepts, regardless of the advancement of sewing, inputting of a fixed planned suspension timing, the suspending instruction of sewing, and the resuming instruction of sewing. The embroidery data memory unit 5 stores the embroidery data 51 that describes the operation procedure of forming an embroidery pattern.

In addition, the suspension timing selecting unit 7 selects a discontinuous operation which breaks the continuity of seams within the range before and after the planned suspension timing accepted by the input unit among the embroidery data 51. During the sewing of the embroidery pattern, when the timing for the discontinuous operation selected by the suspension timing selecting unit 7 comes, the suspension control unit 8 maintains the deactivation of the sewing-machine motor 15 until the suspending instruction or the resuming instruction is input.

Hence, the sewing of the embroidery pattern can be appropriately suspended near the timing set freely by the user. Accordingly, it is unnecessary for the user to pay attention to the advancement of the embroidery pattern and the operation prediction on the sewing machine 1 until the completion of embroidery pattern, and an embroidery with an excellent quality can be finished.

In addition, this sewing machine 1 includes an informing unit such as the screen display device 321. This informing unit informs the user the incoming of the discontinuous operation selected by the suspension timing selecting unit 7 during the sewing of the embroidery pattern. This enables the user to know that the suspension timing is coming, and prevents the user concentrating on the sewing from continuing the sewing.

Still further, the jump operation that changes the pattern block to be sewn among the plurality of pattern blocks of the embroidery pattern, or the color changing operation of changing the threads to the threads with different colors are selected as the candidate of the discontinuous operation which becomes the suspension timing. However, the present disclosure is not limited to this case, and a timing appropriate for sewing suspension, that is, the timing that does not decrease the quality of the embroidery even if the threads are cut in the halfway of the sewing can be selected as the candidate.

As for the detection of the suspension timing, the time required until the discontinuous operation is accumulated based on the embroidery data 51, the difference between the accumulation time until the discontinuous operation and the time at which the planned suspension timing comes is calculated, and based on the calculated difference, the discontinuous operation near the planned suspension timing is selected. Typically, the required time table memory unit 6 stores a table that describes the required time information 63 of the movement of the embroidery frame 26, and the required time information 63 of the discontinuous operation. The suspension timing selecting unit 7 accumulates the required time until the discontinuous operation based on the required time table 61 and the embroidery data 51.

However, as long as the timing appropriate for suspension can be searched near the planned suspension timing, the timing may be determined based on the specification of the sewing machine 1 and the specification of the embroidery data.

For example, the required time of each operation from the initial seam number 53 may be accumulated, and the seam number 53 of the operation corresponding to the planned suspension timing may be specified. In the embroidery data 51, the command that indicates the nearest discontinuous operation before this seam number 53 may be searched, and the command that indicates the nearest discontinuous operation after the seam number 53 may be searched. Next, the time difference from the planned suspension timing to both commands may be obtained by accumulating the required time, and the execution timing of the discontinuous operation with the smaller time difference may be set as the suspension timing.

In addition, when the sewing machine 1 executes the P-th statement 52 arranged in the embroidery data 51, the rotation speed of the sewing-machine motor 6 may be rate-limited relative to the slowest rotation speed of the sewing-machine motor 6 in each statement 52 among up to the (P+N)-th statements. In a case, for example, the moving amount information 62 that has the longest moving distance among the moving amount information 62 indicated by each statement 52 from the P-th statement to the (P+N)-th statement is 8.5 mm, as illustrated in FIG. 8, when the P-th statement 52 is executed, the sewing-machine motor 6 is rotated at 250 rpm. In a case the moving amount information 62 indicated by the (P+N+1)-th statement 52 is 10.3 mm, and when the (P+1)-th statement 52 is executed, the sewing-machine motor 6 is rotated at 150 rpm.

In this case, as for the required time, in the calculation of the accumulation time Ti, the required time of the P-th process is set as the longest required time of the process among the required times of the processes up to the (P+N)-th process, the required time of the (P+1)-th process is set as the longest required time of the process among the required times of the processes up to (P+N+2) process, and the required time of the (P+2)-th process is set as the longest required time of the process among the required times of the processes up to (P+N+2)-th process, and those required times are added to the accumulation time Ti in sequence.

Second Embodiment

Next, a sewing machine 1 according to a second embodiment will be described in detail with reference to the figures. The same structure and same function as those of the first embodiment will be denoted by the same reference numeral, and the detailed description thereof will be omitted.

The suspension timing selecting unit 7 of this sewing machine 1 re-selects the discontinuous operation near the planned suspension timing when manually resuming the deactivated sewing-machine motor 15 that is not automatically driven again, and changes the suspension timing when the discontinuous operation that matches the condition changes.

a manual resuming is a control to drive the sewing-machine motor 15 in response to the depressed start button 323*a* of the switch 323, and the time from the deactivation of the sewing-machine motor 15 to the motor is driven again is uncertain. As example events that need the manual resuming are the color changing operation, sewing suspension desired by the user who operates the deactivate switch of the switch 323, and a power suspension, such as a blackout or a disconnection of the power plug. Note that the jump operation once deactivates the sewing-machine motor 15, but after the embroidery frame 26 is moved, the sewing-machine motor 15 is automatically driven again by the control device 3.

This suspension timing selecting unit 7 compares the remaining time Tr from which a sewing time Te is subtracted with the accumulation time Ti until the discontinuous operation from the manual resuming, and updates the discontinuous operation to be the suspension timing. When the discontinuous operation updated by the suspension timing selecting unit 7 comes, the suspension control unit 8 executes the suspension process.

Note that the sewing time Te is a time elapsed from the start of the sewing of the embroidery pattern to the manual resuming. The suspension timing selecting unit 7 may count the sewing time Te using a CPU clock from the start of sewing of the embroidery pattern, or may obtain both clock times of the start of the sewing of the embroidery pattern and of the manual resuming from the clock IC 324, and may calculate a difference therebetween.

Figure 20:
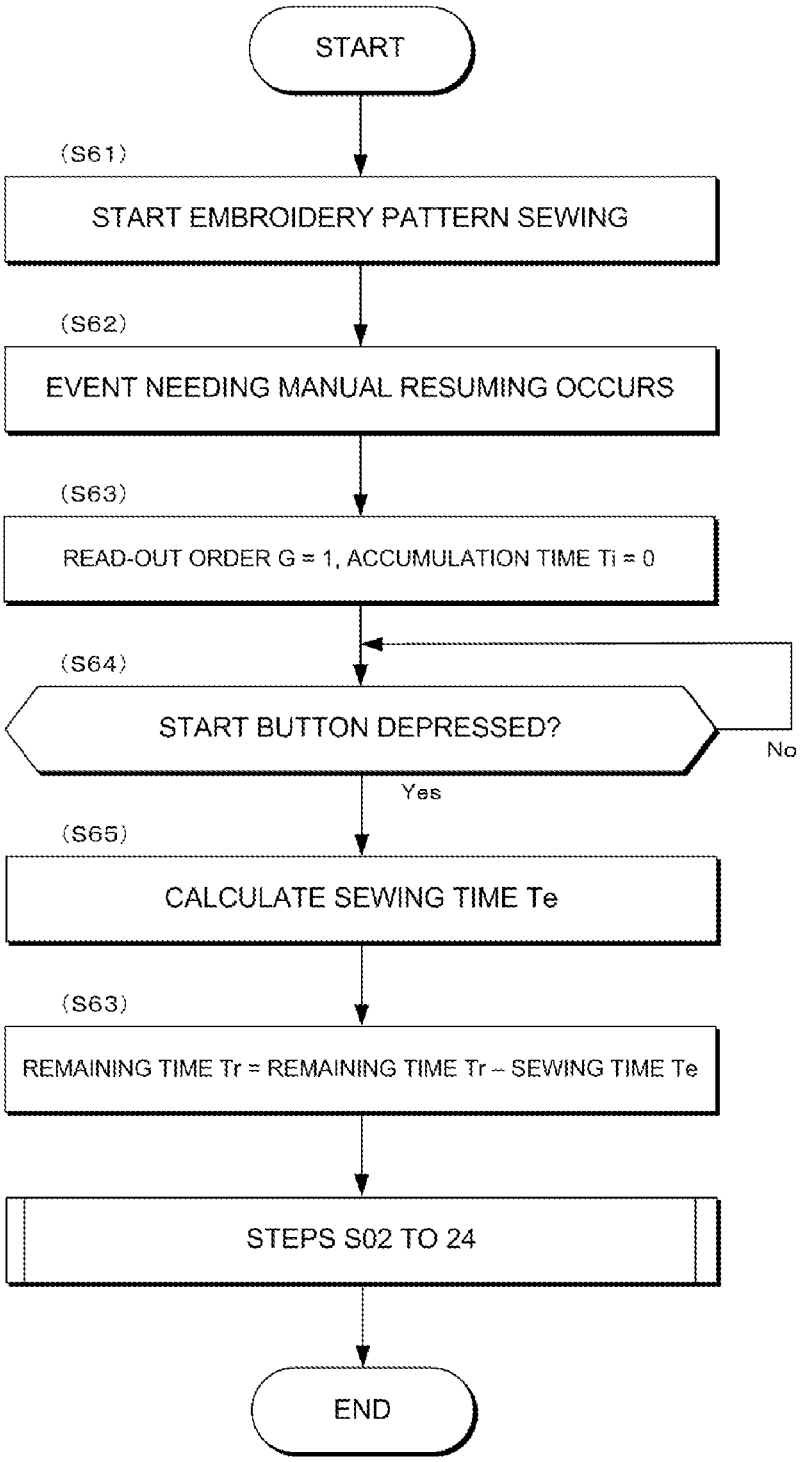
FIG. 20 is a flowchart illustrating a selecting operation of the suspension timing at the time of manual resuming.

FIG. 20 is a flowchart illustrating a re-selecting operation by this suspension timing selecting unit 7. When the sewing of the embroidery pattern starts (step S61), and when an event that needs the manual resuming occurs (step S62), the suspension timing selecting unit 7 initializes the read-out order G=1 and the accumulation time Ti=0 (step S63). When the event, such as a power suspension, that needs the manual resuming suddenly occurs, the suspension timing selecting unit 7 compares the clock time at which the last operation was executed with the clock time of the power recovery, enabling a detection of an occurrence of the event that needs the manual resuming.

After the event that needs the manual resuming occurs, the sewing machine 1 stands by until the start button 323*a* of the switch 323 is depressed (step S64). When the start button 323*a* is depressed (step S64: YES), the suspension timing selecting unit 7 calculates the sewing time Te until the start button 323*a* is depressed after the start of the sewing of the embroidery pattern in the step S61 (step S65), and updates the remaining time Tr that is obtained by subtracting the sewing time Te from the remaining time Tr originally set by the remaining time setting unit 4.

Next, the suspension timing selecting unit 7 executes the step S02 to the Step S24 illustrated in FIGS. 9 to 12 from the process order after manual resuming, detects the discontinuous operation that is within the predetermined range before and after the planned suspension timing, selects one discontinuous operation matching the condition, such as nearest to the planned suspension timing, among the detected discontinuous operations, and changes the value of the suspension timing variable to the seam number 53 of the selected discontinuous operation.

(Action)

Figure 21A:
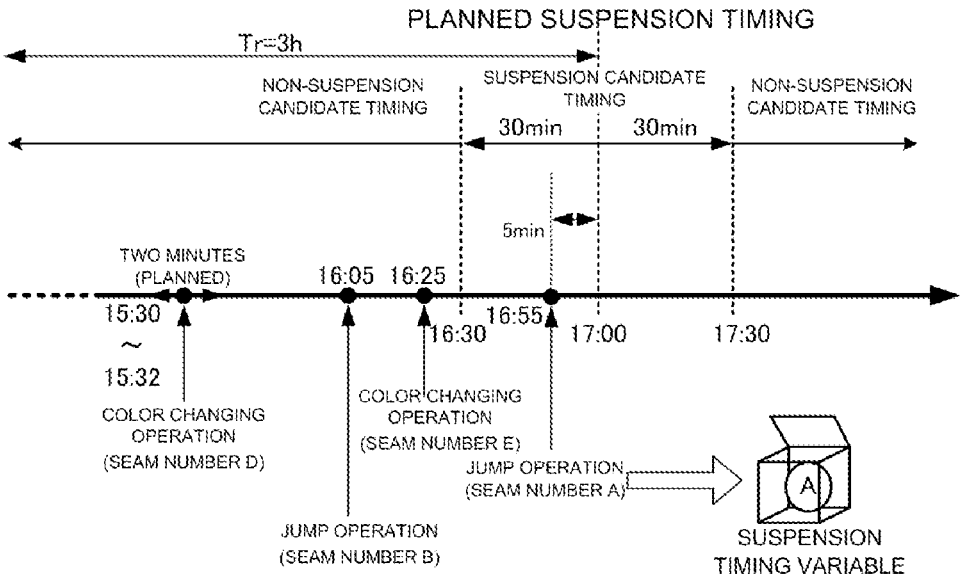
FIGS. 21A and 21B are each a time-series diagram illustrating the time relation between the planned suspension timing and the suspension timing when manual resuming is involved.

As illustrated in FIG. 21A, in the embroidery pattern formation schedule, since the planned suspension timing has been set at exactly 5:00 p.m., that is three hours later, at the start of the sewing of the embroidery pattern, the jump operation to be executed at 4:55 p.m. has been selected as the suspension timing. This suspension timing is obtained by calculating the required time of the color changing operation to be executed at 3:30 p.m. as two minutes.

Figure 21B:
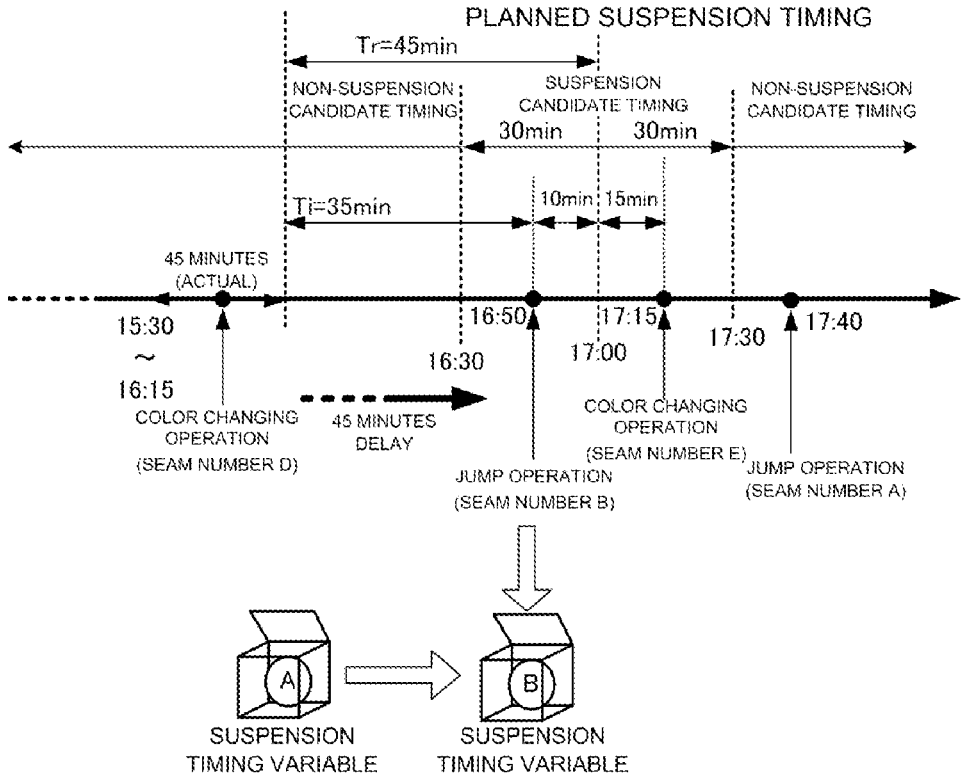

However, as illustrated in FIG. 21B, since the user took other activity, such as shopping, in the color changing operation executed at 3:30 p.m., the change of the colored thread was not carried out promptly, and this color changing operation took 45 minutes. Hence, the jump operation to be executed at 4:55 p.m. is presently to be executed at 5:40 p.m., and is not suitable as the suspension timing.

In contrast, at the start of the sewing of the embroidery pattern, the jump operation to be executed at 4:05 p.m. is executed at 4:50 p.m. In this case, since the color changing operation that is supposed to be two minutes required 45 minutes, the jump operation which has the execution time changed to be at 4:50 p.m. becomes nearest to exactly 5:00 p.m. that is the planned suspension timing.

The suspension timing selecting unit 7 re-selects the suspension timing to be at 4:15 p.m. at which the color changing operation executed at 3:30 p.m. has been completed and the next seam formation is started. The remaining time Tr set as 3 hours is changed to 45 minutes by subtracting the sewing time Te that is 2 hours 15 minutes. The jump operation that has the execution time changed to be at 4:50 p.m. is detected together with the accumulation time Ti that becomes 35 minutes because the accumulation is started from the next seam formation to the color changing operation. Next, the suspension timing selecting unit 7 determines that the jump operation with the accumulation time Tr which is 35 minutes which has the minimum difference that is 10 minutes from the remaining time Tr which is 45 minutes as the suspension timing nearest to exactly 5:00 p.m., and updates the suspension timing variable by the seam number of this jump operation.

Figure 22:
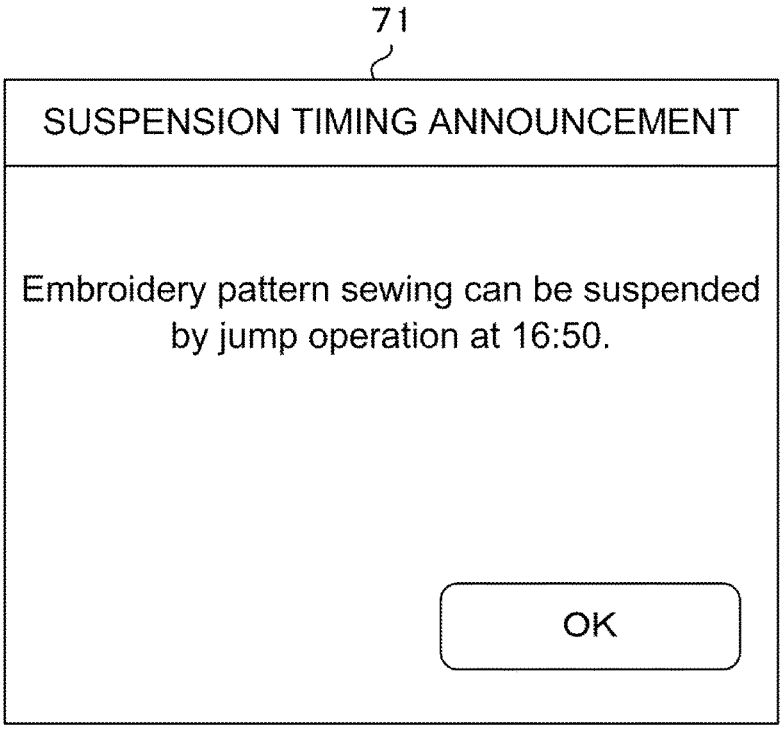
FIG. 22 is a schematic diagram illustrating a suspension timing announcing screen.

FIG. 22 is a schematic diagram illustrating a suspension timing announcing screen. When the suspension timing is selected, the suspension timing selecting unit 7 creates a suspension timing announcing screen 71, and displays this screen on the screen display device 321. The suspension timing announcing screen 71 has a layout including character strings that clarifies the suspension timing. For example, a character string such as "sewing of the embroidery pattern can be appropriately suspended at the jump operation at 4:50 p.m." is displayed.

Note that this suspension timing announcing screen 71 can be displayed at the time of the start of the sewing of the embroidery pattern, and the manual resuming. When the suspension timing changes at the time of the manual resuming, information such as "the suspension timing is changed. Sewing of the embroidery pattern can be appropriately suspended at the jump operation at 4:50 p.m." may be given.

In addition, although the planned suspension timing is set at exactly 5:00 p.m. that is 3 hours later, there is no jump operation and the color changing operation that can be the suspension timing within a predetermined range before and after the planned suspension timing, that is, within 30 minutes. In this case, when there is no discontinuous operation within the predetermined range before and after the planned suspension timing, for example, the suspension timing announcing screen 71 may display a character string such as "there is no timing to suspend the sewing of the embroidery around 5:00 p.m.".

However, since the user took other activity such as shopping in the color changing operation executed at 3:30 p.m., the change of the colored threads is not promptly carried out, and the color changing operation expected to be two minutes took 45 minutes. Hence, the jump operation at 4:05 p.m., which has a difference of equal to or greater than 30 minutes from the remaining time Tr that is 3 hours, is shifted to 4:50 p.m. that is within 30 minutes relative to the remaining time Tr.

In this case, the suspension timing selecting unit 7 selects the jump operation shifted to 4:50 p.m. by the re-selecting process, and stores the seam number of this jump operation in the suspension timing variable. Next, the suspension timing announcing screen 71 may display a character string indicating the presence of the suspension timing near the planned suspension timing, such as "jump operation at 4:50 p.m. enables the suspension of embroidery pattern sewing".

(Effect)

As described above, this sewing machine 1 accepts, via the input unit such as the start button 323*a* of the switch 323, the sewing resuming operation by the user relative to the deactivated sewing-machine motor that is not automatically driven again. The suspension timing selecting unit 7 re-selects one discontinuous operation within the predetermined range before and after the planned suspension timing in the embroidery data 51 every time the sewing resuming operation is input. When the discontinuous operation reselected by the suspension timing selecting unit 7 comes during the embroidery pattern sewing, the suspension control unit 8 maintains the deactivation of the sewing-machine motor 15 until the suspending instruction or the resuming instruction is input.

Depending on the time required until the manual resuming, the sewing schedule of the embroidery pattern may be advanced or delayed. In contrast, the planned suspension timing is fixed. Hence, the discontinuous operation located near the planned suspension timing may change. In addition, although there is no discontinuous operation within the predetermined range before and after the planned suspension timing, the discontinuous operation may newly be presented within the predetermined range before and after the planned suspension timing depending on the time required until the manual resuming. Still further, the discontinuous operation may be eliminated even when it is originally within the predetermined range before and after the planned suspension timing.

According to this sewing machine 1, even if the embroidery pattern sewing schedule is changed, by changing the suspension timing, the embroidery pattern sewing can be appropriately suspended near the timing set freely by the user. This enables the user to complete the embroidery with an excellent quality without paying attention to the advancement of the embroidery pattern and the operation prediction of the sewing machine 1 until the completion of the embroidery pattern.

Third Embodiment

Next, a sewing machine 1 according to a third embodiment of the present disclosure will be described in detail with reference to the figures. The same structure and same function as those of the first or second embodiment will be denoted by the same reference numeral, and the detailed description thereof will be omitted.

Figure 23:
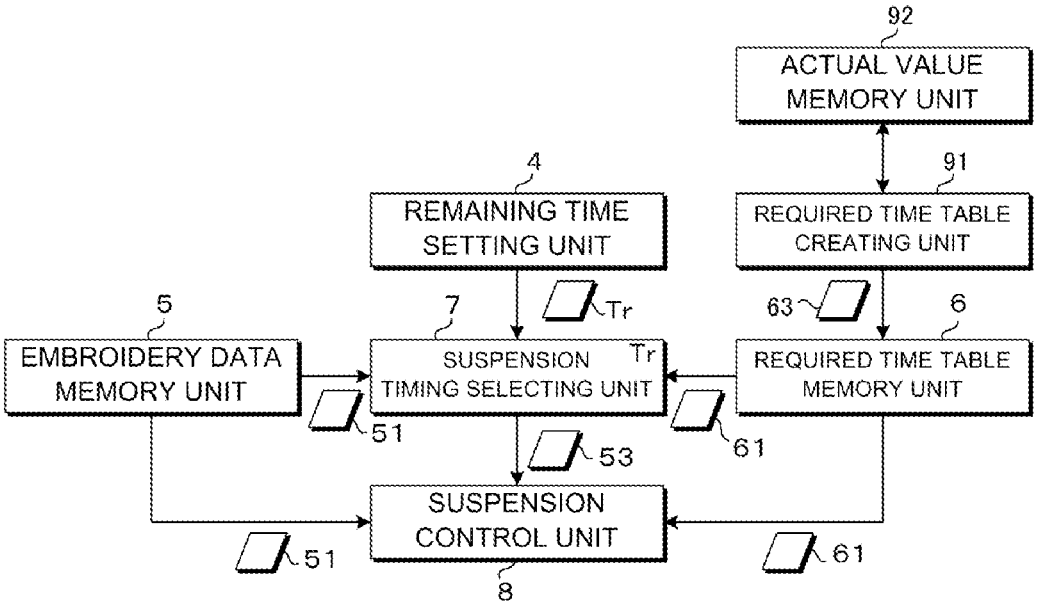
FIG. 23 is a block diagram illustrating another example software configuration of the control device for the sewing machine.

As illustrated in FIG. 23, the control device 3 of the sewing machine 1 includes a required time table creating unit 91 and an actual value memory unit 92. The required time table creating unit 9 mainly includes the processor 311 and the ROM 314. The actual value memory unit 92 includes the ROM 314. This required time table creating unit 9 changes the required time planned relative to the operation which maintains the deactivation of the sewing-machine motor 15 until the user gives the resuming operation based on the actual past record. Such an operation is, for example, the color changing operation.

The required time table creating unit 91 deactivates the sewing-machine motor 15 for the color changing operation, then clocks a time until the user depresses the start button 323*a* of the switch 323, and stores the predetermined number of or all actual required times needed for the operation in the actual value memory unit 92. Next, the required time table creating unit 91 calculates the value of the required time information 63 to be written in the required time table 61 from the actual required time stored in the actual value memory unit 92, and updates, in the required time table 61, the required time information 63 associated with the command that instructs this operation. Although any well-known scheme is applicable to the calculation, but for example, averaging may be applied.

Figure 24:
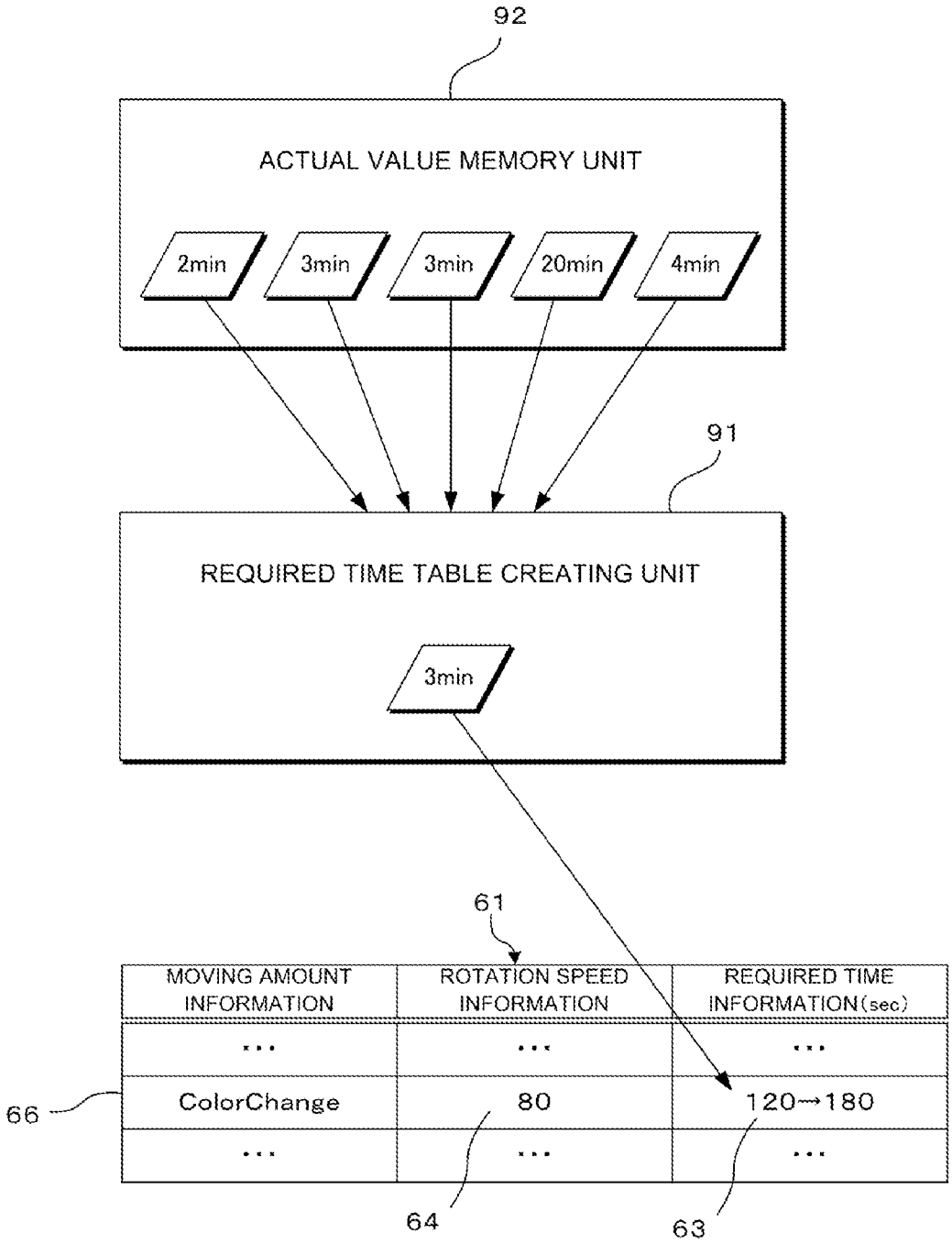
FIG. 24 is a schematic diagram for explaining adjustment in accordance with the actual record of required time information.

For example, as illustrated in FIG. 24, it is assumed that the required time information 63 which is associated with the color change command 66 and which indicates two minutes in default is recorded. In practice, it is assumed that the actual required times of the past five color changing operations are two minutes, three minutes, three minutes, 20 minutes, and four minutes. The required time table creating unit 9 averages the four required times other than 20 minutes that is an extreme value, obtains the averaging result that is three minutes, and updates the value of the required time information 63 associated with the color change command 66 to three minutes.

As described above, according to this sewing machine 1, based on the required time that was actually taken from a certain operation that needs the manual resuming to the next operation procedure, the required time information 63 associated with this certain operation in the required time table 61 is updated.

This enables the required time of the operation that needs the manual resuming to become close to the actual required time, enabling the user to suspend the embroidery pattern sewing appropriately with a further reliability near the timing set freely by the user. That is, the reliability of the suspension timing selected by the suspension timing selecting unit 7 is improved.

Fourth Embodiment

Next, a sewing machine 1 according to the fourth embodiment of the present disclosure will be described in detail with reference to the figures. The same structure and same function as those of the first to third embodiments will be denoted by the same reference numeral, and the detailed description thereof will be omitted.

According to this sewing machine 1, the suspension timing selecting unit 7 displays all the discontinuous operations near the planned suspension timing on the screen display device 321, and stores the seam number of the selected suspension timing by the user in the suspension timing variable.

Figure 25:
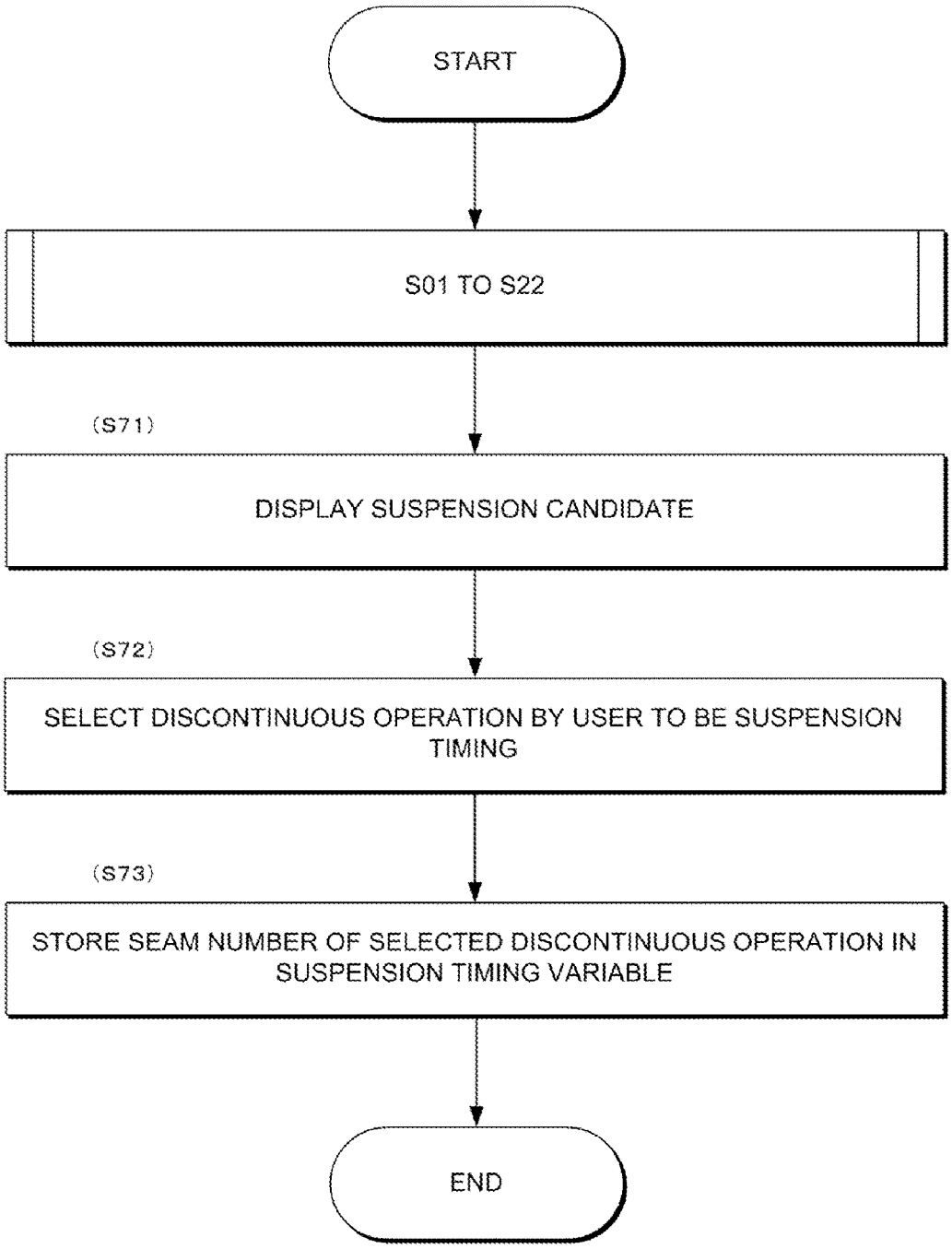
FIG. 25 is a flowchart illustrating another example selecting operation of the suspension timing.

FIG. 25 is a flowchart illustrating the operation of the suspension timing selecting unit 7. As illustrated in FIG. 25, the suspension timing selecting unit 7 executes the steps S01 to S22 as illustrated in FIG. 9 to FIG. 12, to register, in the suspension candidate, the discontinuous operations arranged in time series within the predetermined range before and after the planned suspension timing in association with the type of the discontinuous operation, the seam number, and the accumulation time Ti.

Next, the suspension timing selecting unit 7 displays, on the screen display device 321, the type of the discontinuous operation registered in the suspension candidate and the execution timing thereof (step S71). The execution timing is expressed by the accumulation time Ti itself or the clock time at which the accumulation time Ti elapses. When the user selects a certain discontinuous operation by a touch operation etc. (step S72), the seam number 53 of the selected discontinuous operation is stored in the suspension timing variable (step S73).

Figure 26:
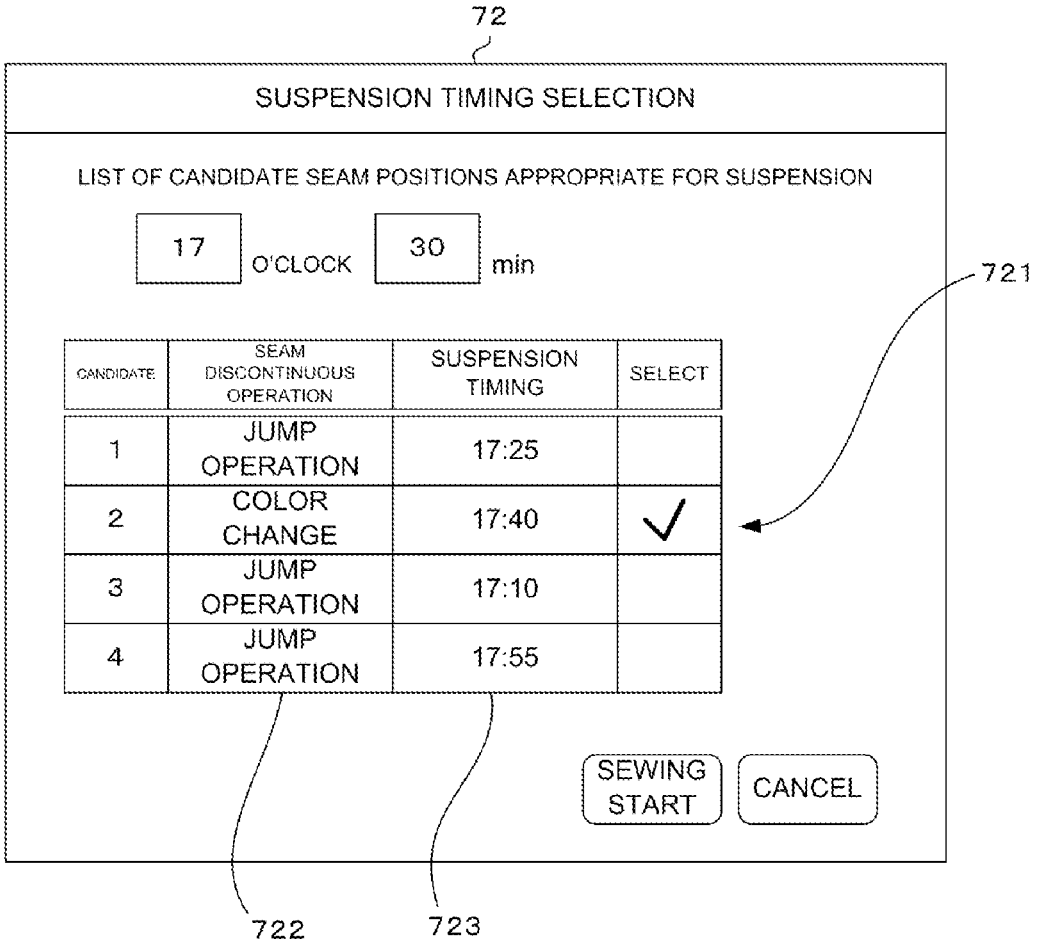
FIG. 26 is a schematic diagram illustrating a suspension timing selecting screen.

FIG. 26 is a schematic diagram illustrating the suspension timing selecting screen 72 that is displayed by the suspension timing selecting unit 7 on the screen display device 321. The suspension timing selecting screen 72 displays a list 721 that arranges suspension timings candidate within the predetermined range before and after the planned suspension timing. The displayed suspension timing candidate is a set of name information 722 that indicates the type of the discontinuous operation executed at the suspension timing, for example, the color changing operation or the jump operation, and the clock time information 723 that indicates the suspension timing. The suspension timing selecting unit 7 stores, in the suspension timing variable, the seam number 53 of the touched suspension timing via this suspension timing selecting screen 72.

The displayed suspension timing may be the accumulation time Ti or a clock time. When it is the clock time, the time obtained by adding accumulation time Ti to the present time is displayed. The order of a display may be an order from near the planned suspension timing, and may be in the type of specific operation. When sorting in accordance with the type of the certain operation is adopted, it is desirable to place the color changing operation in a higher order. This is because the color changing operation is the operation most suitable for suspension.

Thus, according to this sewing machine 1, the suspension timing selecting unit 7 detects the plurality of the discontinuous operations within the predetermined range before and after the planned suspension timing, and displays, on the screen display device 321, the list of type of the detected discontinuous operation and the execution timing thereof. Next, the input unit such as the touch panel 322 accepts a selection from the list displayed on the screen display device 321, and the suspension control unit 8 maintains the deactivation of the sewing-machine motor 15 when the discontinuous operation selected from the screen using the input unit comes.

Accordingly, the user can determine the schedule in view of the suspension timings candidate while maintaining a balance between the desire to concentrate on the embroidery pattern sewing and the importance of the other activities.

In addition, according to this sewing machine 1, the suspension timing selecting unit 7 displays, on the screen display device 321, the detected discontinuous operations arranged type by type. This improves the user friendliness such that the user can determine the suspension timing in view of an importance of the quality of the embroidery creation, in view of time and effort. For example, the color changing operation requires time and effort, and the user may desire to set the color changing operation as the suspension timing, and in such a case, when the candidates are arranged by the type of the discontinuous operation, it is useful to the user.

Fifth Embodiment

Next, a sewing machine 1 according to a fifth embodiment of the present disclosure will be described in detail with reference to the figures. The same structure and same function as those of the first to fourth embodiments will be denoted by the same reference numeral, and the detailed description thereof will be omitted.

Figure 27:
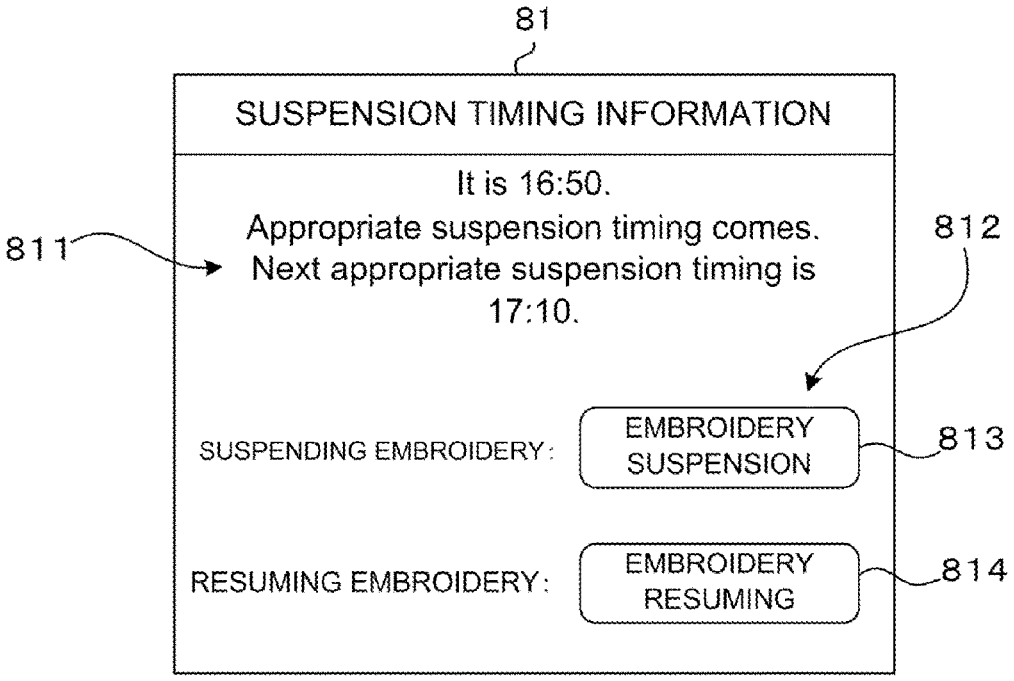
FIG. 27 is a schematic diagram illustrating another example suspension timing informing screen.

The suspension control unit 8 determines whether to suspend the sewing or to further resume the sewing when the user keeps sewing without a suspension even when the suspension timing has come. FIG. 27 is a schematic diagram illustrating another example suspension timing informing screen 81 displayed by the suspension control unit 8 on the screen display device 321. As illustrated in FIG. 27, the suspension control unit 8 displays the execution timing of the next discontinuous operation on an informing area 811, and displays the suspension button 813 and the resuming button 814.

The suspension control unit 8 checks the following operation after the seam number 53 of the last operation in sequence within the embroidery data 51, and finds the command that indicates the first discontinuous operation. Simultaneously, the required time is accumulated from the last executed seam number 53, calculating the next suspension timing.

Consequently, according to this sewing machine 1, after the selected discontinuous operation comes, as long as the user instructs to resume, every time the new discontinuous operation comes, the suspension timing informing screen 81 is displayed, causing the user to check whether to suspend at the next discontinuous operation, or to resume the sewing. This allows the user who can spend a time for sewing even when the planned suspension timing has elapsed to further resume the sewing.

Other Embodiments

Although the embodiments of the present disclosure have been described above, various omissions, replacement, and modifications can be made thereto without departing from the scope of the present disclosure. Such embodiments and modified forms thereof are within the scope of the present disclosure, and also within the scope of the invention as recited in appended claims and the equivalent range thereto.

What is claimed is:

1. A sewing machine that sews an embroidery pattern in a sewing object, the sewing machine comprising:

a frame driving unit moving an embroidery frame on which the sewing object is placed and stretched;

a needle bar supporting a needle that inserts a thread in the sewing object, and reciprocating in an axial direction;

a sewing-machine motor that is a driving source of the needle bar; and a control unit controlling the frame driving unit and the sewing-machine motor, wherein the control unit comprises:

an input unit accepting, regardless of an advancement of sewing, input of a fixed planned suspension timing, a suspending instruction of sewing, and a sewing resuming instruction;

an embroidery data memory unit storing embroidery data which describes an operation procedure for forming an embroidery pattern;

a suspension timing selecting unit selecting an operation which breaks a continuity of seams within a predetermined range before and after the planned suspension timing accepted by the input unit; and a suspension control unit maintaining, when operation which breaks a continuity of seams re-selected by the suspension timing selecting unit comes, a deactivation of the sewing-machine motor until the suspending instruction or the resuming instruction is input, during the sewing of the embroidery pattern.

2. The sewing machine according to claim 1, wherein the control unit further comprises an informing unit informing a user an incoming of the operation which breaks the continuity of the seams selected by the suspension timing selecting unit during the sewing of the embroidery pattern.

3. The sewing machine according to claim 1, wherein the suspension timing selecting unit selects the operation which breaks the continuity of seams nearest to the planned suspension timing.

4. The sewing machine according to claim 1, wherein:

the control unit further comprises a screen display device; and the suspension timing selecting unit displays, on the screen display device, the operation which breaks the continuity of seams within a predetermined range before and after the planned suspension timing, and selects one of the operations which breaks the continuity of seams selected by a user from the screen display device via the input unit.

5. The sewing machine according to claim 4, wherein the suspension timing selecting unit displays, on the screen display device, the operations which break the continuity of seams arranged type by type.

6. The sewing machine according to claim 1, wherein the operation which breaks the continuity of seams is a jump operation of changing a pattern block to be sewn among a plurality of the pattern blocks of the embroidery pattern, or a color changing operation of changing the threads to the threads with different colors.

7. The sewing machine according to claim 1, wherein:

the input unit accepts a sewing resuming operation by the user to the deactivated sewing-machine motor that is not automatically driven again;

the suspension timing selecting unit re-selects one of the operation which breaks the continuity of seams within a predetermined range before and after the planned suspension timing among the embroidery data of after the resuming every time the sewing resuming operation is input; and the suspension control unit maintains when operation which breaks the continuity of seams re-selected by the suspension timing selecting unit comes, the deactivation of the sewing-machine motor until the suspending instruction or the resuming instruction is input, during the sewing of the embroidery pattern.

8. The sewing machine according to claim 1, wherein:

the control unit further comprises a table memory unit storing a table which describes a time required for moving the embroidery frame, and a time required for the operation which breaks the continuity of seams;

the suspension timing selecting unit calculates, a difference between the planned suspension timing and an execution timing of the operation which breaks the continuity of seams based on the table and the embroidery data, and detects, the operation which breaks the continuity of seams within a predetermined range before and after the planned suspension timing based on the difference.

9. The sewing machine according to claim 8, wherein the control unit further comprises a table creating unit updating the time required for the operation which breaks the continuity of seams within the table based on a time actually required from a start of execution of the operation which breaks the continuity of seams until the next operation in the past.

10. The sewing machine according to claim 1, wherein:

the control unit further comprises a non-volatile memory; and the suspension control unit stores, when the suspending instruction is input, the embroidery data and information indicating the operation next to the operation which breaks the continuity of seams involving the deactivation of the sewing-machine motor selected by the suspension timing selecting unit in the non-volatile memory.

11. The sewing machine according to claim 2, wherein the informing unit informs the user the coming of the operation which breaks the continuity of seams every time a new operation which breaks the continuity of seams comes as long as the resuming instruction is input.

* * * * *